US012765615B2

(12) United States Patent
Scott et al.

(10) Patent No.: US 12,765,615 B2
(45) Date of Patent: Oct. 20, 2026

(54) INFANT POSITIONING SWADDLE

(71) Applicant: TORTLE PRODUCTS LLC, Greenwood Village, CO (US)

(72) Inventors: Jane Scott, Georgetown, TX (US); Brendan Fitch, Castle Rock, CO (US)

(73) Assignee: TORTLE PRODUCTS LLC, Greenwood Village, CO (US)

( * ) Notice: Subject to any disclaimer, the term of this patent is extended or adjusted under 35 U.S.C. 154(b) by 0 days.

(21) Appl. No.: 18/997,294

(22) PCT Filed: Apr. 11, 2024

(86) PCT No.: PCT/US2024/024145

§ 371 (c)(1),
(2) Date: Jan. 21, 2025

(87) PCT Pub. No.: WO2024/220307

PCT Pub. Date: Oct. 24, 2024

(65) Prior Publication Data

US 2026/0033557 A1 Feb. 5, 2026

Related U.S. Application Data

(60) Provisional application No. 63/496,631, filed on Apr. 17, 2023.

(51) Int. Cl.
*A41B 13/06* (2006.01)

(52) U.S. Cl.
CPC ..... *A41B 13/065* (2013.01)

(58) Field of Classification Search
CPC ..... A41B 13/06; A41B 13/065; A47G 9/083; A47G 9/1045; A47G 9/109; A47D 15/008
See application file for complete search history.

(56) References Cited

U.S. PATENT DOCUMENTS 2,952,856 A * 9/1960 Ruff ..... A47G 9/10 D6/716.3
3,924,282 A * 12/1975 Bond ..... A47C 20/027 5/632

(Continued)

FOREIGN PATENT DOCUMENTS

KR 200483853 Y1 6/2017
WO 9116842 A1 11/1991

(Continued)

OTHER PUBLICATIONS

"International Search Report and Written Opinion for PCT/US2024/024145, mailed on Aug. 7, 2024 12 pages".

(Continued)

*Primary Examiner* — Heather Mangine
(74) *Attorney, Agent, or Firm* — Dorsey & Whitney LLP

(57) ABSTRACT

A positioning swaddle includes positioning rolls secured to a swaddle blanket. The positioning rolls maintain an infant's torso in a desired position. The swaddle blanket wraps an infant. Securing straps may be used to secure the positioning swaddle to an infant. An optional apron covers the infant's legs and feet. Optional support rolls support the neck or legs for improved health outcomes. Optional pockets receive pillows or pads for increased versatility of the positioning swaddle.

27 Claims, 17 Drawing Sheets

(56) References Cited

U.S. PATENT DOCUMENTS 4,800,600 A * 1/1989 Baum ..... A47D 15/008 5/93.1
4,872,228 A * 10/1989 Bishop ..... A47D 15/008 5/513
4,873,734 A * 10/1989 Pollard ..... A47D 15/008 5/946
5,020,174 A * 6/1991 Sarkozi ..... A47G 9/10 5/951
5,165,130 A * 11/1992 Wendling ..... A47D 15/008 5/655
5,189,748 A * 3/1993 Garrison ..... A47D 15/008 5/655
5,226,193 A * 7/1993 Chen ..... A47G 9/083 2/69.5
5,309,926 A * 5/1994 Mayton ..... A47D 5/00 128/869
5,331,699 A * 7/1994 Patton ..... A47D 15/008 5/655
5,341,531 A * 8/1994 Straub ..... A47D 15/008 5/655
5,347,669 A * 9/1994 Neviaser ..... A47D 15/008 5/655
RE34,763 E * 10/1994 Tucker ..... A47D 15/008 2/69.5
5,351,348 A * 10/1994 Beger ..... B23K 7/10 D6/333
5,361,435 A * 11/1994 Reeves ..... A45C 3/10 5/931
5,367,730 A * 11/1994 Sher ..... A47D 15/008 5/655
5,371,909 A * 12/1994 McCarty ..... A47D 13/08 5/655
5,383,711 A * 1/1995 Houghteling ..... B60N 2/882 5/636
5,450,640 A * 9/1995 Patton ..... A47D 15/003 5/915
5,499,418 A * 3/1996 Tan ..... A47D 13/08 5/655
5,530,974 A * 7/1996 Rains ..... A61G 7/1026 5/81.1 T
5,546,620 A * 8/1996 Matthews ..... A47D 13/08 5/639
5,692,257 A * 12/1997 Albertieri ..... A47D 5/00 5/655
D389,359 S * 1/1998 Nowak ..... D6/333
5,713,090 A * 2/1998 Rodgers ..... A47D 15/008 135/124
5,826,287 A * 10/1998 Tandrup ..... A47D 13/08 5/655
5,916,089 A * 6/1999 Ive ..... A47D 15/006 5/655
5,937,461 A * 8/1999 Dombrowski ..... A47D 15/008 5/655
6,145,932 A * 11/2000 Hamel-Nyhus ..... B60N 2/2881 297/219.12
D446,675 S * 8/2001 Straub ..... A47D 15/003 D6/333
6,321,403 B1 * 11/2001 Matthews ..... A47D 15/008 5/655
6,381,787 B1 * 5/2002 Rogone ..... A47D 13/08 5/655
6,640,366 B1 * 11/2003 Draves ..... A47C 20/023 5/630
6,814,405 B2 * 11/2004 Norman ..... B60N 2/2881 5/655
6,859,960 B1 * 3/2005 Jerome ..... A47G 9/08 5/413 R
7,131,156 B1 * 11/2006 Walker-Craft ..... A47G 9/1045 5/639
7,614,098 B1 * 11/2009 Quarry ..... A47D 15/008 24/711.1
8,458,830 B1 * 6/2013 Pierce ..... A41B 13/06 5/413 R
8,667,631 B2 * 3/2014 Coates ..... A41B 13/06 5/655
9,332,791 B1 * 5/2016 Bush ..... A47D 15/003
9,380,896 B2 7/2016 Carangelo
10,117,523 B1 * 11/2018 Hionakis ..... A47D 15/008
10,925,382 B1 * 2/2021 Jones ..... A47G 9/08
11,109,689 B1 * 9/2021 Heisey ..... A47D 15/003
11,517,488 B2 * 12/2022 Bader ..... A61G 7/065
12,075,936 B2 * 9/2024 Voegel ..... A47C 7/383
D1,061,087 S * 2/2025 Leonhardt ..... D24/190
12,396,493 B1 * 8/2025 Dumaplin ..... A41B 13/06
12,402,731 B1 * 9/2025 Kim ..... A47D 13/08
12,446,715 B1 * 10/2025 Wright ..... A47G 9/1045
2001/0032357 A1 * 10/2001 Fuentes ..... A47C 31/105 5/482
2004/0019969 A1 * 2/2004 Gatten ..... A41B 13/06 2/69.5
2005/0011008 A1 * 1/2005 Welch ..... A47D 9/016 5/655
2005/0015881 A1 * 1/2005 Littlehorn ..... A47D 15/006 5/636
2005/0210583 A1 * 9/2005 Cook ..... A47D 15/02 5/413 R
2005/0210592 A1 * 9/2005 Littlehorn ..... A47D 15/003 5/655
2005/0278857 A1 * 12/2005 Fairchild ..... A47D 15/008 5/655
2006/0016005 A1 * 1/2006 Roda ..... A41B 13/06 5/482
2007/0044199 A1 * 3/2007 Ebert ..... A47D 15/008 2/111
2007/0245494 A1 * 10/2007 Dockendorf ..... A47D 13/083 5/655
2008/0307577 A1 * 12/2008 Leckband ..... A47G 9/0207 5/482
2008/0313812 A1 * 12/2008 Reeves ..... A47D 13/02 5/655
2009/0007336 A1 * 1/2009 Kassai ..... A47D 13/08 5/655
2009/0249526 A1 * 10/2009 Carangelo ..... A47G 9/1045 2/243.1
2010/0257653 A1 * 10/2010 Pitts ..... A41B 13/06 2/69.5
2010/0275373 A1 * 11/2010 Kaplan ..... A41B 13/06 5/494
2011/0083276 A1 * 4/2011 Pieta ..... A41B 13/06 5/655
2011/0191956 A1 * 8/2011 Rabess ..... A47D 15/008 5/424
2011/0225738 A1 * 9/2011 Vensel ..... A47D 15/008 5/655
2011/0277210 A1 * 11/2011 Hardesty ..... A47D 15/008 5/655
2013/0283527 A1 * 10/2013 Houston ..... A41B 13/06 5/494
2013/0333113 A1 * 12/2013 Gotel ..... A41B 13/06 5/494
2014/0041123 A1 * 2/2014 North ..... A47G 9/10 5/632
2015/0101101 A1 4/2015 Gotel et al.
2015/0237934 A1 * 8/2015 Kirkland ..... A41D 13/1281 2/455
2016/0174731 A1 * 6/2016 Pulley ..... A47D 15/005 128/878
2016/0219942 A1 * 8/2016 McCampbell ..... A41B 13/06
2017/0055592 A1 * 3/2017 Stephan ..... A41B 13/06
2017/0135506 A1 * 5/2017 Holmes ..... A47G 9/1009
2017/0318865 A1 * 11/2017 Karnati ..... A47D 15/008
2018/0014667 A1 * 1/2018 Ibrahim ..... A47G 9/10
2018/0228222 A1 8/2018 Barski et al.
2019/0069686 A1 * 3/2019 Miller ..... A47G 9/1036
2019/0216233 A1 * 7/2019 McLusky ..... A47D 15/008
2020/0345159 A1 * 11/2020 Mighali ..... A47G 9/083
2021/0137291 A1 * 5/2021 Hwang ..... A47G 9/083
2021/0219752 A1 * 7/2021 Sutovsky ..... A47G 9/1045

(56) References Cited

U.S. PATENT DOCUMENTS

| | | | | |
|---|---|---|---|---|
| 2021/0282577 | A1* | 9/2021 | Leezer-Cumiford | A47G 9/1081 |
| 2022/0053838 | A1* | 2/2022 | Scott, Jr. | A61F 5/37 |
| 2022/0279940 | A1* | 9/2022 | Groden | A47G 9/1081 |
| 2023/0389620 | A1* | 12/2023 | Barnard | A41B 13/06 |
| 2024/0008663 | A1* | 1/2024 | Melendez | A47G 9/1027 |

FOREIGN PATENT DOCUMENTS

| | | | |
|---|---|---|---|
| WO | 2014125472 | A1 | 8/2014 |
| WO | 2024220307 | | 10/2024 |

OTHER PUBLICATIONS

European Patent Office, "Extended European Search Report," mailed Dec. 18, 2025, for European Application No. 24793266.8, 11 pages.

* cited by examiner

INFANT POSITIONING SWADDLE

CROSS REFERENCE TO RELATED APPLICATION(S)

This application is a 371 of International Patent Application No. PCT/US2024/024145, filed Apr. 11, 2024, which claims priority to U.S. Provisional Application No. 63/496,631, filed Apr. 17, 2023. The aforementioned applications are incorporated herein by reference, in its entirety, for any purpose.

TECHNICAL FIELD

The technology described herein relates to positioning swaddles and methods of using the same.

BACKGROUND

Prematurely born infants are often at risk for compromised cerebral blood flow and respiratory distress, and are often unable to maintain their body temperatures without assistance. Prematurely born infants often require medical intervention to manage these risks and to promote their health and viability. Common interventions include ventilator support, feeding tubes, intravenous (IV) fluid support, catheters including Foley catheters, heart rate monitoring, and heating pads. The standard of care may also include midline supine positioning for an initial 96 hours, which helps to promote optimal cerebral blood flow and uniform distribution of respiratory support to the lungs.

When a prematurely born infant is physiologically more stable, such as after the initial 96-hour midline supine positioning period, the infant may benefit from being positioned on the right and left side of the body.

Some infants experience hypoxic or anemic conditions during delivery, such as those associated with meconium aspiration and fetomaternal hemorrhage. These infants may benefit from therapeutic hypothermia to reduce inflammation and limit neurological damage. Hypothermia can be induced by placing an infant on a cooling pad. An infant may also benefit from "kangaroo" care, in which the infant is placed in direct skin-to-skin contact on the chest of a parent. Kangaroo care promotes temperature regulation, heart and respiratory rate normalization, ready access to breastfeeding, and parent-child bonding.

Swaddling an infant provides a sense of confinement and slight pressure, similar to the experience of being in the womb, and thus may provide comfort to an infant. Swaddling an infant soothes the infant and helps an infant to fall asleep and remain asleep.

The information included in this Background section of the specification, including any references cited herein and any description or discussion thereof, is included for technical reference purposes only and is not to be regarded as subject matter by which the scope of the invention as defined in the claims is to be bound.

SUMMARY

The technology disclosed herein relates to positioning swaddles. The positioning swaddles may be used to assist supine positioning of prematurely born infants, swaddle infants, and cover an infant during kangaroo care. A positioning swaddle may transition between configurations or uses without having to move the infant. The same positioning swaddle may be used for one infant as the infant grows and its health improves. In examples, the positioning swaddle includes positioning aids, such as positioning rolls secured to a swaddle blanket. The positioning rolls may be adjustable to accommodate an infant of any size by rolling them towards or away from the infant. In examples, the infant's torso remains accessible while the positioning rolls are in place or positioned, such as to permit placement, removal, and monitoring of medical equipment, such as catheters or electrodes. In examples, the positioning rolls minimize movement of an infant's torso, maintain an infant's torso in the desired position, and deflect an infant's moving torso back to the desired position. The swaddle blanket may provide warmth and a sense of security for the infant.

In some embodiments, securing straps are provided with the swaddle and positioning aids. The securing straps may secure the positioning swaddle to an infant and provide a sense of security for the infant.

In some embodiments, an apron is provided with the positioning swaddle and positioning aids. The apron may provide warmth and a sense of security to an infant, or support for the legs and hips of the infant.

In some embodiments, a neck support roll is provided with the positioning swaddle and positioning aids. The neck support roll may support an infant's head or neck, and promotes an open airway and uniform distribution of respiratory support to the lungs.

In some embodiments, a pillow pocket is provided with the positioning swaddle and positioning aids. The pillow pocket may accommodate a pillow on which the head or neck of the infant rests to promote and maintain proper positioning.

In some embodiments, a leg support roll is provided with the positioning swaddle and positioning aids. The leg support roll may support an infant's legs or hips, and aid in optimal body positioning for proper hip alignment and central nervous system (CNS) development.

In some embodiments, a pad pocket is provided with the positioning swaddle and positioning aids. The pad pocket may accommodate a heating or cooling pad that regulates the temperature of an infant. The pad pocket may help to maintain the heating or cooling pad in the proper position.

In one implementation, a kit is provided including the positioning swaddle, one or more support rolls, and a washable bag.

In another implementation, a method for using the positioning swaddle, such as to support an infant in a supine position, is provided. An infant is placed on its back on a swaddle blanket, the positioning rolls are rolled up in a portion of the swaddle blanket, and are secured in the rolled configuration by flaps. The secured, wrapped positioning rolls are rolled toward the infant until adjacent to the infant's torso. Access to the torso, and any previously placed catheters or electrodes, may be maintained when the positioning rolls are in place, which minimizes stress on the infant. The positioning rolls help to prevent the infant's torso from moving, which thereby maintains the infant in a supine position.

In another implementation, a method for using the positioning swaddle, such as to support an infant while the infant is lying on its side, is provided. The infant is placed on a swaddle blanket on its side. The swaddle blanket and positioning rolls may be used according to the method described above. The positioning rolls may be positioned towards the front and back of the infant's torso and help to prevent the torso from moving away from the side-lying position.

In another implementation, a method for using the positioning swaddle, such as to swaddle an infant, is provided. An infant is placed on its back on a swaddle blanket and the positioning rolls are drawn along the swaddle blanket and positioned adjacent to the infant's torso. The swaddle blanket may be wrapped around the infant, which soothes the infant, helps the infant to fall asleep and remain asleep, etc.

In another implementation, a method for using the positioning swaddle, such as to provide kangaroo care, is provided. The positioning rolls may be used according to the method described above for swaddling. The infant may be positioned in direct skin-to-skin contact with the bare chest of an adult, which promotes heart and respiratory rate normalization and provides ready access to breastfeeding. In such examples, the swaddle blanket covers the back of the infant, which provides warmth.

In another implementation, a method for using the positioning swaddle including securing straps, such as to secure the positioning swaddle to the infant, is provided. The swaddle blanket and positioning rolls may be used according to any method described above. The securing straps may be wrapped around the infant, which helps provide a sense of security for the infant.

In another implementation, a method for using the positioning swaddle including an apron, such as to provide warmth, is provided. The swaddle blanket and positioning rolls may be used according to any method described above. The infant's feet and legs may be positioned in or on the apron, and the apron may be folded over the feet or legs, which helps keep an infant warm and feeling secure.

In another implementation, the apron is rolled up and positioned underneath the legs of an infant, which helps support the infant's legs and hips.

In another implementation, a method for using the positioning swaddle including a support roll, such as to support the neck of an infant and promote an open airway, is provided. The swaddle blanket and positioning rolls may be used according to any method described above. The support roll, which may be secured to the swaddle blanket, may be positioned under the neck of an infant. The infant's neck is thereby supported in a position that promotes an open airway, which may be helpful for any prematurely born infant, including one who requires respiratory support.

In another implementation, a method for using the positioning swaddle including a pillow, such as to support the head or neck of an infant and promote proper positioning, is provided. The swaddle blanket and positioning rolls may be used according to any method described above. The pillow, which may be positioned within a pocket secured to the swaddle blanket, may be positioned under the head or neck of an infant. The infant's head or neck is thereby supported in a position that prevents plagiocephaly, and the pocket helps maintain the pillow in its proper position.

In another implementation, a method for using the positioning swaddle including a support roll, such as to support the legs or hips of an infant, is provided. The swaddle blanket and positioning rolls may be used according to any method described above. The support roll may be positioned under the legs of an infant. The infant's legs and hips are thereby supported in a position that aids in optimal body positioning, which may be helpful for development of proper hip alignment and the CNS in an infant, including a prematurely born infant.

In another implementation, a method for using the positioning swaddle with a heating or cooling pad, such as to regulate the temperature of an infant, is provided. The heating or cooling pad, which may be positioned within a pocket secured to the swaddle blanket, may be positioned under at least the torso of an infant. The temperature of the infant's core is thereby maintained, increased, or decreased as desired.

In another implementation, the positioning swaddle is transitioned between any of the methods described above without removing the infant from the swaddle, which minimizes disturbance to medical devices and the infant, minimizes stress on the infant, and eases caregiving, among other benefits.

In another implementation, a single positioning swaddle is transitioned between any of the methods described above as the infant grows and/or as the infant's health and medical needs change over time, without the need for a different or larger swaddle, which reduces caregiving costs.

In another implementation, a positioning swaddle includes a substantially rectangular fabric swaddling blanket including two lateral ends. The positioning swaddle may include a cylindrically shaped, compression-resistant positioning roll attached to each lateral end of the swaddling blanket. The swaddling blanket may include a center section secured at a juncture to an at least one flap and to an at least one wing, wherein the wing is secured to the positioning roll. The wing may wrap around the positioning roll in a rolled configuration. The flap may include a fastener. The fastener may secure the positioning roll and wing in the rolled configuration. The positioning rolls may support the torso of an infant in a supine or side-lying position when the positioning rolls are in the rolled configuration. The positioning rolls in the rolled configuration may define an adjustable gap between them for sizing to accommodate the torso of an infant. The positioning rolls may be configured to provide access to the torso for placement, removal, or monitoring of a medical device attached to the torso of the infant when the positioning rolls are in the rolled configuration. The positioning swaddle may include at least one securing strap capable of securing the positioning swaddle to an infant. The positioning swaddle may include an apron secured to a bottom edge of the swaddling blanket. The apron may be a pouch configured to receive the feet or legs of an infant. The positioning swaddle may include a support roll configured for releasable attachment to the swaddle blanket near a midpoint between the positioning rolls. The support roll may support the neck of an infant. The support roll may include a depression. The support roll may be configured such that the neck of the infant rests on the depression. The positioning swaddle may include a pocket secured to a back surface of the swaddling blanket. The pocket may be configured to receive a temperature regulating pad. The positioning swaddle may include a pocket secured to a top edge of the swaddling blanket. The pocket may be configured to receive a pillow.

In another implementation, a positioning swaddle includes a swaddle blanket including a center section including two lateral ends, two flaps each including a proximal end and a distal end, and two wings each including a proximal end and a distal end. Each lateral end of the center section may be secured to the proximal end of a respective flap at a juncture, and to the proximal end of a respective wing at the juncture. A respective cylindrically shaped positioning roll may be secured to the distal end of each wing. The positioning rolls may define an adjustable gap between them for sizing to accommodate the torso of an infant. The distal end of one flap may wrap around the positioning roll on the distal end of the opposing wing when the swaddle blanket is wrapped around an infant. The positioning swaddle may include at least one securing strap capable of securing the positioning swaddle to an infant. The positioning swaddle may include a foldable and rollable apron secured to a bottom edge of the center section.

In another implementation, a positioning swaddle kit includes a positioning swaddle, at least one support roll, and a launderable or washable bag. The positioning swaddle may include a substantially rectangular fabric swaddling blanket including two lateral ends. The positioning swaddle may include a cylindrically shaped, compression-resistant positioning roll attached to each lateral end of the swaddling blanket. The support roll may support the neck of an infant.

In another implementation, a method of positioning an infant in a supine or side-lying position includes placing the infant in the supine or side-lying position on a positioning swaddle. The positioning swaddle may include a swaddle blanket. The swaddle blanket may include a center section including two lateral ends. The swaddle blanket may include two flaps each including a proximal end and a distal end. The swaddle blanket may include two wings each including a proximal end and a distal end. Each lateral end of the center section may be secured to the proximal end of a respective flap at a juncture, and to the proximal end of a respective wing at the juncture. A respective cylindrically shaped positioning roll may be secured to the distal end of each wing. The method may include wrapping each wing around the respective positioning roll from the distal end to the proximal end of the wing. The method may include securing each flap to the respective wing wrapped around the respective positioning roll to form a positioning wrap. The method may include rolling the positioning wrap towards the infant until the positioning wrap is positioned adjacent to the infant. The method may include securing the positioning swaddle to the infant by wrapping at least one securing strap around both positioning rolls and the infant. The method may include inserting feet of the infant into an apron, wherein the apron is secured to a bottom edge of the center section of the swaddling blanket. The method may include rolling an apron and positioning legs of the infant on top of the rolled apron, wherein the apron is secured to a bottom edge of the center section of the swaddling blanket.

In another implementation, a method of swaddling an infant includes placing the infant in a supine position on a positioning swaddle. The positioning swaddle may include a substantially rectangular fabric swaddling blanket. The swaddling blanket may include a center section including two lateral ends. The swaddling blanket may include two flaps. The swaddling blanket may include two wings. The swaddling blanket may include at least one securing strap. Each wing may be adjacent to one flap. Each lateral end of the center section may be secured at a juncture to the adjacent flap and the adjacent wing. The positioning swaddle may include a cylindrically shaped, compression-resistant positioning roll attached to each wing at an end distal from the juncture at which the wing is attached to the center section and the respective flap. The method may include drawing each positioning roll and respective wing towards the infant until each roll is adjacent to the infant. The method may include drawing one of the two flaps across the infant and securing the flap under the opposing positioning roll. The method may include drawing the other of the two flaps across the infant and securing the flap under the opposing positioning roll. The method may include securing the positioning swaddle to the infant by wrapping the at least one securing strap around the swaddled infant. The positioning swaddle may include an apron secured to a bottom edge of the center section of the swaddling blanket. The apron may be folded over at least a portion of the infant. The method may include rolling each positioning roll towards or away from the infant to adjust a distance between the positioning rolls.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

BRIEF DESCRIPTION OF THE DRAWINGS

FIG. 2 is a rear plan view of the infant positioning swaddle of FIG. 1 with the flaps folded in.

DETAILED DESCRIPTION

Figure 1:
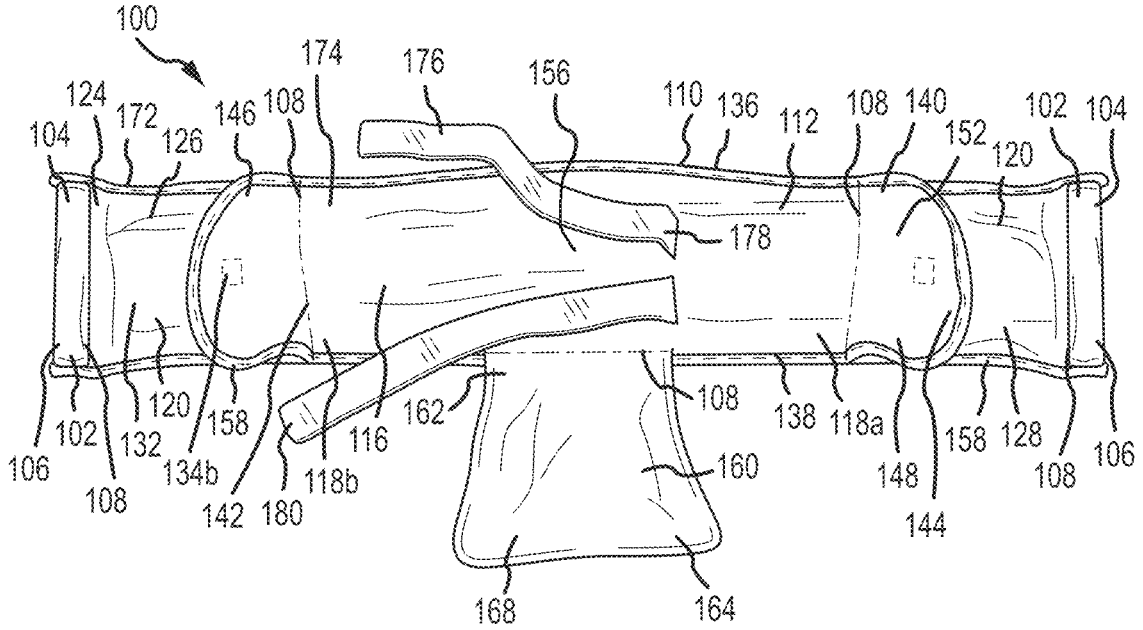
FIG. 1 is a rear plan view of an infant positioning swaddle according to one embodiment.

A positioning swaddle may be generally understood as having positioning rolls secured to a swaddle blanket. In examples, the positioning rolls maintain an infant's body in a desired position, and the swaddle blanket wraps an infant's body. The positioning rolls can be varied in length and/or width to accommodate infants of many sizes, as well as be arranged to define a snug fit relative to the body, helping to increase comfort experienced by the infant. In some implementations, the positioning rolls are rolled up alongside an infant while access to the torso is maintained for placement, removal, or monitoring of medical equipment. In some implementations, the swaddle blanket is wrapped around an infant to provide warmth and/or comfort. In some implementations, the positioning swaddle supports or covers an infant during kangaroo care. The positioning swaddle may be positioned in various configurations without moving the infant off of or out of it, which minimizes stress on the infant.

In some embodiments, a pouch is provided into which the infant's feet are placed, or it is folded over the lower portion of the infant, or it is rolled up to support the infant's legs. In some embodiments, an optional leg support roll provides support for and proper placement of the infant's legs. In some embodiments, an optional neck support roll provides support for the neck and promotes an open airway.

Positioning Swaddle

FIGS. 1-8 depict one embodiment of a positioning swaddle 100. The positioning swaddle 100 includes positioning rolls 102 secured to a swaddle blanket 110, which includes a center section 112, wings 120, and flaps 140.

The swaddle blanket 110 may be constructed of any one or more soft fabric materials known in the art. The fabric material may be any natural or synthetic fabric such as cotton, elastane or spandex, microfiber, polyester, rayon, silk, viscose, or wool, or any combination thereof. The fabric may be woven, unwoven, or knit. A knit may be a smooth or ribbed knit. The material may be flexible, stretchable, wicking, breathable, cooling, fire retardant, machine washable, or any combination thereof.

In the construction and use of the swaddle blanket 110, a non-insulating fabric may help prevent an infant's body temperature from rising, reduce an infant's body temperature as compared to an insulating fabric, and/or allow temperature and humidity from a controlled environment (e.g., from that generated via an incubator) to more readily pass through the infant skin. Non-insulating fabrics include fabrics that are wicking, breathable, and/or cooling.

A wicking fabric draws moisture away from skin and may also transfer it to a next, more outer, layer. Drawing moisture away from the skin helps regulate body temperature. For example, drawing moisture away from the skin helps a person feel or stay warmer in cool or cold environments and helps a person feel or stay cooler in warm or hot environments. A wicking fabric may help to prevent moisture buildup on an infant's body, which can occur in certain environments, e.g., hospital incubators or the like that may have an increased humidity for medical purposes. Wicking fabrics may include, for example, cotton, microfiber, polyester, silk, and wool. Wicking fabrics may also include performance-engineered synthetic fabrics such as Capilene® (Patagonia, Ventura, CA), FlashDry™ (The North Face, San Leandro, CA) and DriClime® (Marmot, Rohnert Park, CA).

A breathable fabric allows air to reach the skin and allows water vapor to escape from the fabric. Allowing air to reach the skin and allowing water vapor, usually from humidity due to the environment (e.g., incubator), to escape from the fabric helps to keep the infant comfortable and prevent skin issues, while still allowing positioning within the incubation or other humidity and temperature controlled environment. A breathable fabric may help an infant stay cooler. Breathable fabrics may include, for example, cotton, linen, and silk. Breathable fabrics may also include performance-engineered synthetic fabrics such as Gore-Tex® (breathable and waterproof; W. L. Gore and Associates, Elkton, MD), OmniTech® (breathable and waterproof; Colombia Sportswear Co., Portland, OR) and PolarTec® (breathable and insulating; Marmot, Rohnert Park, CA).

A cooling fabric allows heat to pass away from the skin through the fabric and does not reflect heat back to the skin. Allowing heat to pass through the fabric helps to reduce body temperature and/or prevent body temperature from rising, e.g., infants that may be experiencing withdrawals due to drug exposure in utero may have unusual body temperatures, such as warmer body temperatures and can be benefit from a cooling or uninsulated fabric. Cooling fabrics may include, for example, cotton, linen, and rayon.

The swaddle blanket 110 may be constructed of one or more layers of soft materials, such as one layer or two layers. Each layer may be constructed of one or more pieces joined together by any means known in the art including, but not limited to, stitches, glue, tape, bonding, or any combination thereof. The one or more pieces may meet at one or more seams.

The swaddle blanket 110 may be constructed of one or more pieces of fabric, such as one, three, or five pieces. When the swaddle blanket 110 is constructed of one piece of fabric, a section of the fabric piece may be pinched outward on the back side 174 of the swaddle blanket 110 to form each flap 140. Each flap 140 may be secured at a juncture 108, which may be formed by any known means including, but not limited to, stitches, glue, tape, bonding, or any combination thereof. The juncture 108 may include a seam.

When the swaddle blanket 110 is constructed of three pieces of fabric, one piece may form the center section 112 and both wings 120. Another piece of fabric may form one flap 140 and a third piece of fabric may form a second flap 140. A flap 140 may be secured to both the center section 112 and a wing 120 at a juncture 108. In another embodiment, one piece of fabric may form the center section 112 and both flaps 140. Another piece of fabric may form one wing 120 and a third piece of fabric may form a second wing 120. A wing 120 may be secured to both the center section 112 and a flap 140 at a juncture 108.

When the swaddle blanket 110 is constructed of five pieces of fabric, one piece may form the center section 112, two pieces may separately form each wing 120, and two pieces may separately form each flap 140. The center section may be secured to a wing 120 and a flap 140 at a juncture 108.

The outer edge of at least a portion of the swaddle blanket 110 may include a trim 158, which may be a band, piping, or binding. The trim 158 may be decorative or functional. For example, the trim 158 may secure multiple layers of fabric together. The trim may be secured to the swaddle blanket 110 by any means known in the art including, but not limited to, stitches, glue, tape, bonding, or any combination thereof. If more than one piece of trim is present, the pieces may meet at one or more seams.

The swaddle blanket 110 may have a substantially rectangular shape, with a length longer than the height. The length of the swaddle blanket 110 may be 3 to 7 times greater than its height. For example, the length may be about 4 times greater than the height, or 5.5 times greater than the height. The length may be long enough to swaddle an infant, as described in the methods below. The height may be at least as tall as the length of the torso of an infant.

Figure 8:
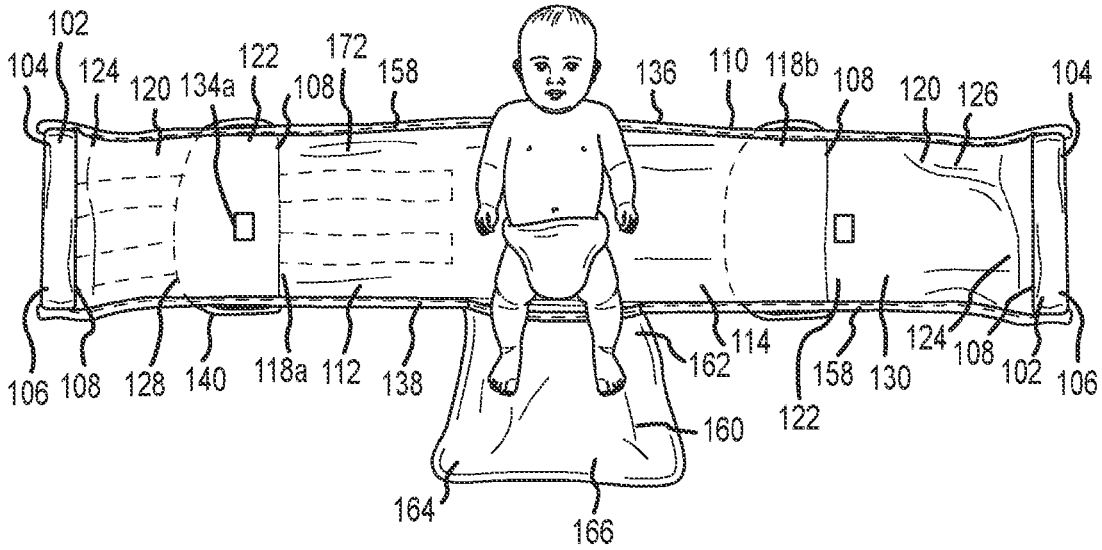
FIG. 8 is a front plan view of the infant positioning swaddle of FIG. 1 in use for positioning an infant in the fully unrolled configuration.

As shown in FIGS. 1 and 8, both the front side 172 and the back side 174 of the swaddle blanket 110 have a substantially rectangular perimeter. As shown in FIG. 1, the back side 174 of the swaddle blanket 110 may be punctuated by one or more protruding flaps 140.

The center section 112 may be substantially rectangular in shape, with a length greater than its height. The center section 112 may comprise about 40 to 70% of the total length of the swaddle blanket 110. For example, the length may be about 55% of the total length of the swaddle blanket 110. The length may be at least long enough to accommodate the width of a torso of an infant.

The center section 112 of the exemplary embodiment may have a front surface 114, back surface 116, top edge 136, bottom edge 138, lateral ends 118*a*, 118*b*, and center 156. The front surface 114 is configured to receive an infant.

The center section 112 may include a pocket (not shown). A pocket near the top edge 136 of the center section 112 may be configured to receive a neck support roll 182, and a pocket near the bottom edge 138 of the center section 112 may be configured to receive a leg support roll.

Each lateral end 118*a*, 118*b* of the center section 112 may be joined to the proximal end 142 of a flap 140 and the proximal end 122 of a wing 120 at a juncture 108.

The swaddle blanket 110 includes one or more, such as two, flaps 140. Each flap 140 helps secure a positioning roll 120 in the rolled configuration, and helps provide lateral support and swaddling for an infant.

Figure 2:
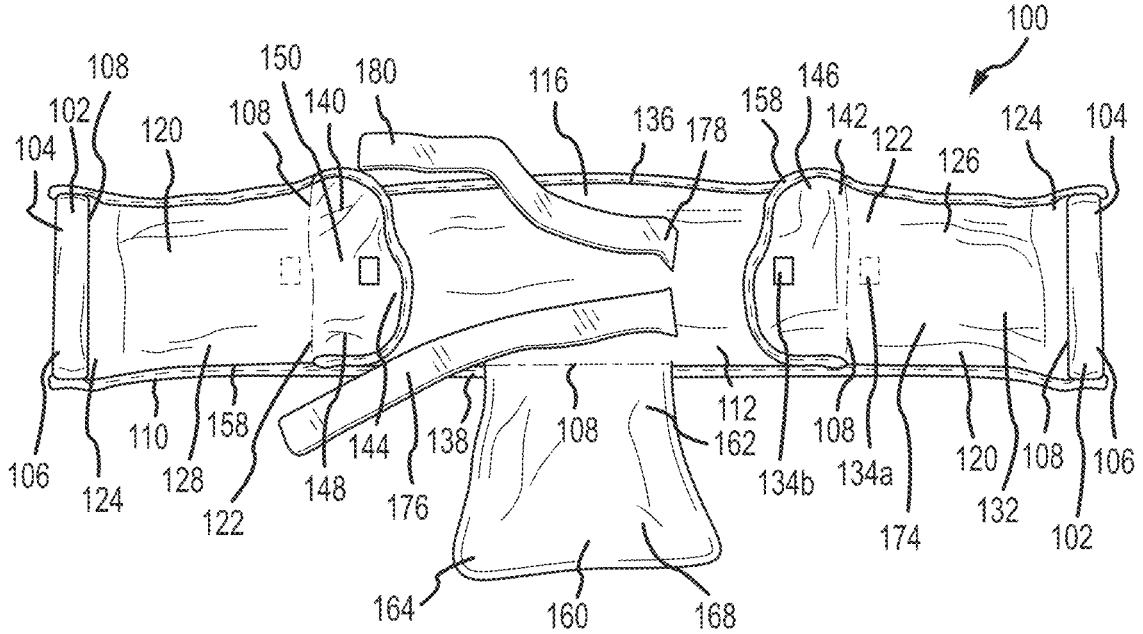
Figure 3:
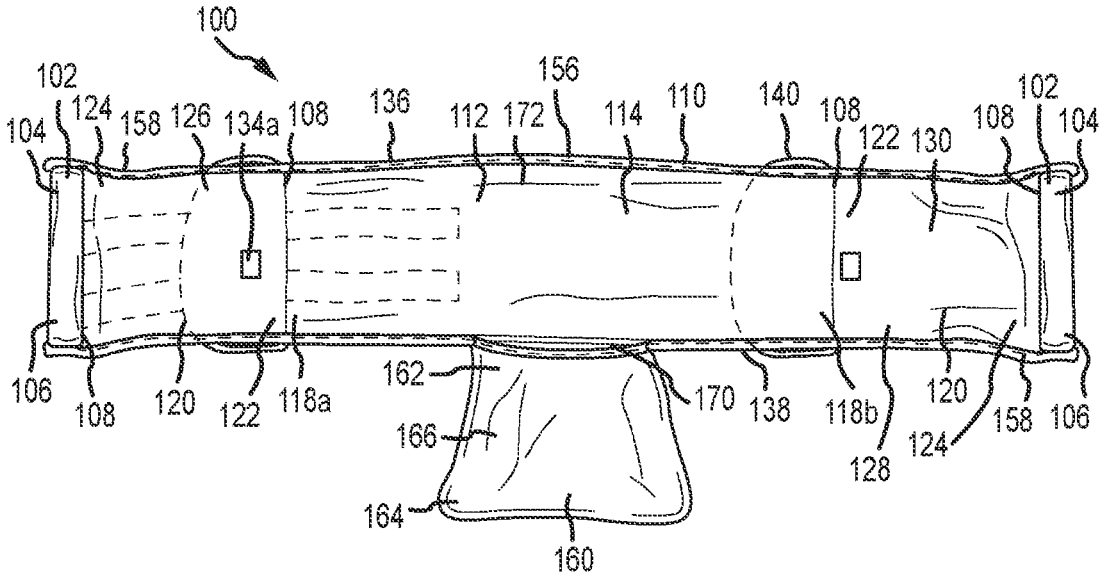
FIG. 3 is a front plan view of the infant positioning swaddle of FIG. 1.
Figure 5:
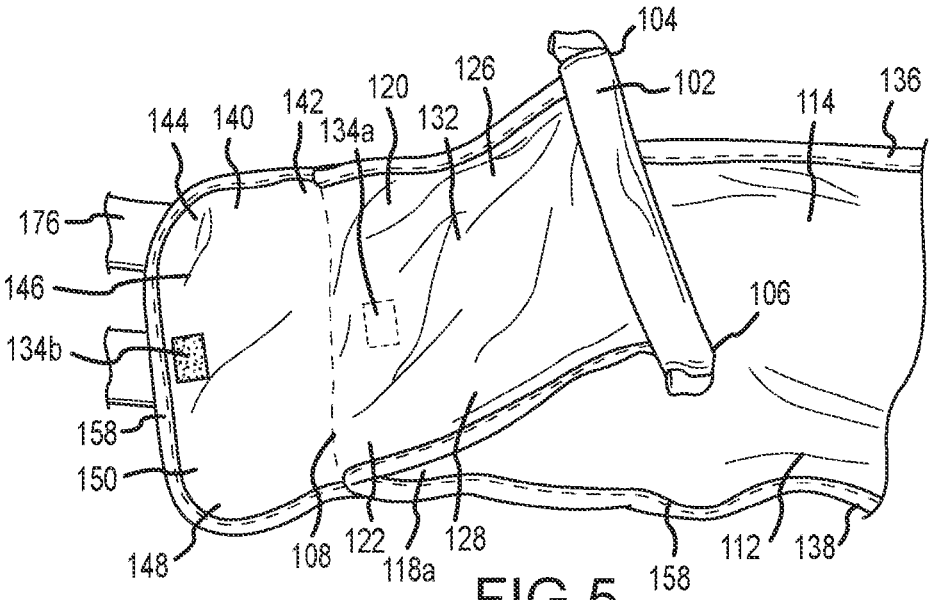
FIG. 5 is a front plan view of a positioning member, wing, and flap of the infant positioning swaddle of FIG. 1 in the partially rolled configuration.

With reference to FIGS. 2, 3 and 5, each flap 140 may be "D"-shaped, with a substantially straight proximal end 142 and a curved distal end 144. The height of each flap 140 may be greater than its length.

Each flap 140 may be about 35 to 65% of the length of a wing 120. For example, the length of a flap 140 may be about 50% of the length of a wing 120. Each flap 140 may be about 5 to 35% of the length of the center section 112. For example, the length of a flap 140 may be about 20 to 25% of the length of the center section 112. The proportions of the flaps 140 to wings 120 or center section 112 are not limited so long as each flap 140 is long enough to secure a positioning roll 120 rolled up in a wing 120.

The distal end 144 includes a fastener 134b, which may be part of, for example, a button-and-hole, snap, hook-and-loop fastener (e.g. VELCRO®), or hook-and-eye fastener. The fastener 134*b*, along with an opposing fastener 134*a* positioned on the adjacent wing 120, is configured to secure the flap 140 to the wing 120 when the wing 120 has been rolled around the adjacent positioning roll 102, as described below.

The swaddle blanket 110 includes one or more, such as two, wings 120. Each wing 120 helps provide adjustability to the positioning swaddle 100, and helps provide lateral support and swaddling for an infant.

With reference to FIGS. 2 and 3, each wing may be substantially rectangular in shape, with a length greater than its height. Each wing 120 may comprise about 10 to 40% of the total length of the swaddle blanket 110. For example, the length may be about 20 to 25% of the total length of the swaddle blanket 110.

Each wing 120 may be about 30 to 50% of the length of the center section 112. For example, the length of a wing 120 may be about 40 to 45% of the length of the center section 112. The proportions of the center section 112 and wings 120 are not limited so long as the center section 112 is long enough to accommodate the width of a torso of an infant, and each wing 120 is long enough to lay across at least most of the width of the torso of an infant.

Each wing 120 of the exemplary embodiment has a distal end 124, proximal end 122, upper portion 126, lower portion 128, first surface 130, and second surface 132. At its distal end 124, the wing 120 is secured to a positioning roll 102, and at its proximal end 122, the wing 120 is secured to the center section 112 of a swaddle blanket 110 at a juncture 108. The proximal end 122 includes a fastener 134*a*, which may be part of, for example, a button-and-hole, snap, hook-and-loop fastener (e.g. VELCRO®), or hook-and-eye fastener. The fastener 134*a*, along with an opposing fastener 134*b* positioned on the adjacent flap 140, is configured to secure the wing 120 to the flap 140 when the wing 120 has been rolled around the adjacent positioning roll 102, as described below.

The positioning swaddle 100 includes one or more, such as two, positioning rolls 102. Each positioning roll 102 helps provide support to an infant.

Figure 4:
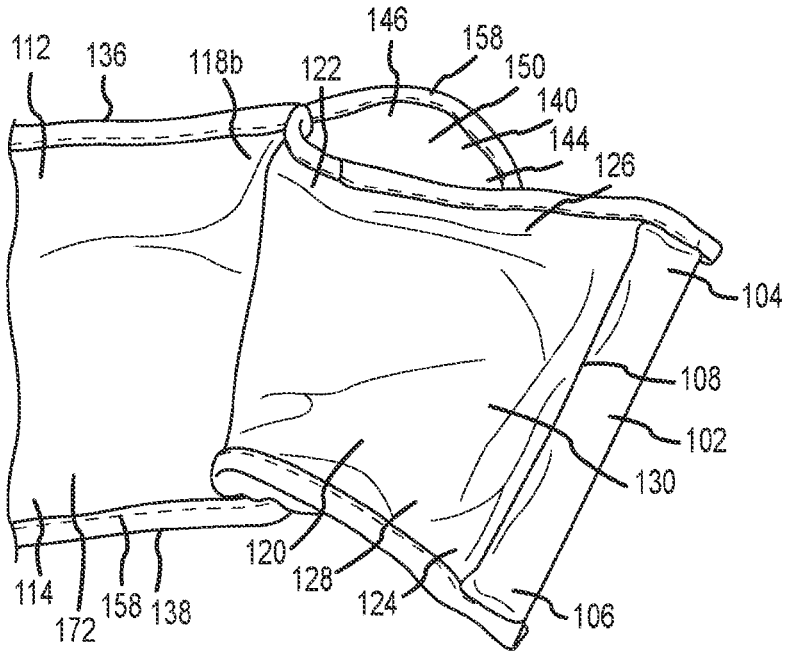
FIG. 4 is a front plan view of a positioning roll and wing of the infant positioning swaddle of FIG. 1.

With reference to FIGS. 4 and 5, each positioning roll 102 may be substantially cylindrically shaped. The positioning rolls 102 may each have the same size or be of different sizes, and may each have the same shape or have different shapes. Each positioning roll 102 is positioned at or near the distal end 124 of a wing 120. Each positioning roll 102 has an upper end 104 positioned at or near the upper portion 126 of the wing 120, and has a lower end 106 positioned at or near the lower portion 128 of the wing 120. Each positioning roll 102 may be the same length as, shorter than, or longer than, the length of the wing 120 at the location to which that positioning roll 102 is secured. Thus, the upper end 104 may extend beyond the upper portion 126 of the wing 120, extend to the upper portion 126, or terminate below the upper portion 126. The lower end 106 may extend beyond the lower portion 128 of the wing 120, extend to the lower portion 128, or terminate above the lower portion 128.

With further reference to FIGS. 4 and 5, each positioning roll 102 is elongated such that its length is greater than its width (diameter). Each positioning roll 102 may have a consistent width along the entire length of the positioning roll 102, or the width may vary along the length. The length may be about 5 to 8 times longer than the width. For example, the length of each positioning roll 102 may be about 6 to 7 times its width.

The positioning rolls 102 may be comprised of a filler. The filler may be, for example, solid foam, memory foam, stuffing, batting, down, synthetic down-like material, gel, or a combination thereof. The filler may be resilient such that it returns to its original shape, or close to its original shape, after being compressed. The filler may be of sufficient quantity, compactness, or firmness that it resists complete compression by the weight of an infant's arms or torso. The filler may be partially compressible, but has enough compression resistance that it helps each positioning roll 102 minimize movement of an infant's arms or torso, maintain an infant's body in a desired position, and deflect an infant's moving body back to the desired position. The compression resistance may be matched to the size and weight of an infant, or to the force exerted by a turning or rolling infant. For example, the filler may compress to about fifty percent or less of its uncompressed thickness when weighted under an infant.

Each positioning roll 102 may include a covering fabric. The covering fabric may be the fabric of the adjacent wing 120 or may be a separate piece of fabric, such as a casing. The casing may be constructed with one more seams.

Each positioning roll 102 is secured to the adjacent wing 120 at one or more junctures 108. A juncture 108 may be formed by any known means including, but not limited to, stitches, glue, tape, bonding, or any combination thereof. A juncture 108 may include a seam. A juncture 108 may extend partially or completely along the length of the positioning roll 102, such as from the upper end 104 to the lower end 106 of a positioning roll 102.

A juncture 108 may secure one portion of the fabric of a wing 120 to another portion of the fabric of the same wing 120 such that a positioning roll 102 is captured by the fabric of the wing 120, as in pocket. The pocket may be nominally larger than the positioning roll 102 such that the positioning roll 102 has no or limited room to move within the pocket.

Figure 6:
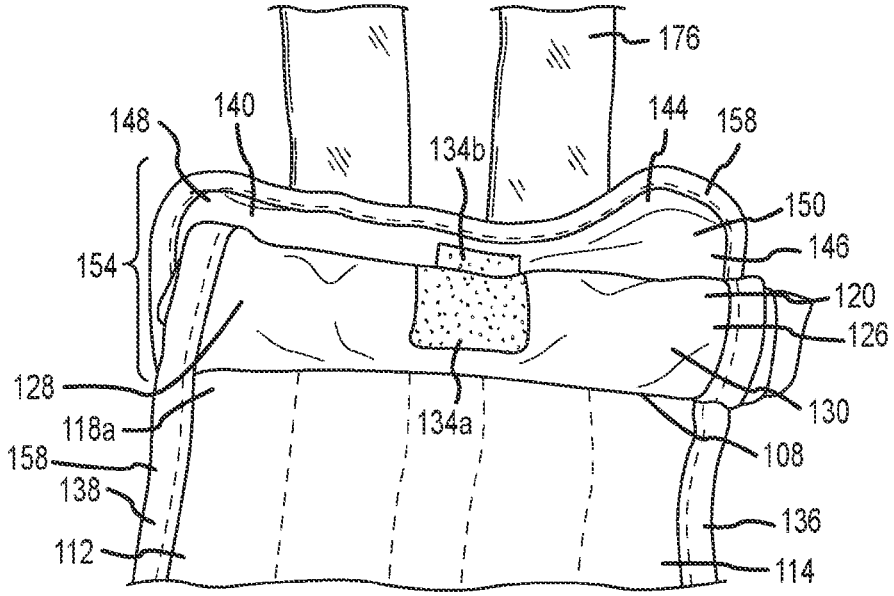
FIG. 6 is a front plan view of a positioning roll of the infant positioning swaddle of FIG. 1 in the rolled configuration.

Securing each positioning roll 102 to an adjacent wing 120 at a juncture 108 helps each positioning roll 102 to be rolled along the adjacent wing 120, thereby rolling the wing 120 around the positioning roll 102. As shown in FIGS. 5 and 6, after a positioning roll 102 and wing 120 are fully rolled up, the adjacent flap 140 is secured to the rolled-up wing 120 by pressing together opposing fasteners 134*a*, 134*b* on the wing 120 and flap 140. As shown in FIG. 6, fastening the fasteners 134*a*, 134*b* secures the positioning roll 102, wing 120, and flap 140 in the fully rolled configuration (hereinafter, positioning wrap 154).

Figure 11:
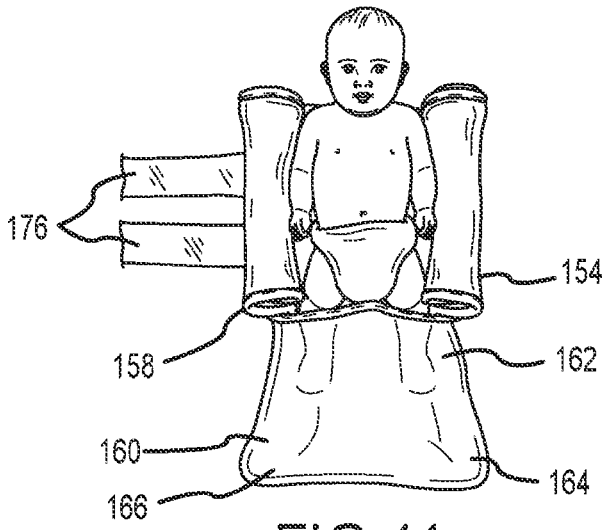
FIG. 11 is a front plan view of the infant positioning swaddle of FIG. 10 with the second positioning member, wing, and flap in the rolled configuration.

With reference to FIG. 11, when the positioning swaddle 100 is in use, and the positioning wraps 154 are positioned adjacent to an infant, the torso of the infant remains exposed, which allows for placement, removal, and monitoring of medical devices, such as catheters and electrodes, without disturbing the infant.

The positioning rolls 102 and positioning wraps 154 minimize movement of an infant's torso, maintain an infant's torso in the desired position, and deflect an infant's moving torso back to the desired position. The positioning wraps 154 may be positioned on the lateral sides of the torso when an infant is in the supine position, which helps maintain the infant in the supine position. The positioning wraps 154 may be positioned toward the front and back of the torso when an infant is lying on its side, which helps maintain an infant in a side-lying position.

In some implementations, the positioning swaddle 100 includes one or more securing straps 176. The securing straps 176 help secure the positioning swaddle 100 to an infant when the positioning swaddle 100 is in use, and provide a sense of security to the infant.

With reference to FIGS. 1 and 2, the depicted securing straps 176 are flexible fabric straps with a substantially rectangular shape. Each securing strap 176 is at least long enough to traverse the torso of an infant, may be long enough to wrap around the side of an infant, and may be many times longer.

Each securing strap 176 may be secured to the back surface 116 of the center section 112 with its fixed end 178 positioned between the center 156 of the center section 112 and a lateral end 118*a* of the center section 112. In another embodiment, the fixed end 178 may be positioned between the center 156 of the center section 112 and a second lateral end 118*b* of the center section 112. In another embodiment, the fixed end 178 may be positioned at or near the center 156 of the center section 112. In still another embodiment, the fixed end 178 may be positioned anywhere along the back side 174 of the swaddle blanket 110.

A securing strap 176 may include a fastener (not shown) at or near its free end 180, which secures the free end 180 to the swaddle blanket 110. The fastener may thereby assist in securing the positioning swaddle 100 to an infant when the securing strap 176 is in use.

When the positioning swaddle 100 is in use, the securing straps 176 can be guided over or around any already placed medical devices, which minimizes disturbance to them and the infant, and minimizes stress on the infant.

In some implementations, the positioning swaddle 100 includes an apron 160. The apron 160 helps provide warmth and a sense of security to an infant, or helps provide support for the legs and hips of the infant.

An apron 160 may be positioned near or at the bottom edge 138 of the center section 112 and may be centered at or near the center 156 of the center section 112. With reference to FIGS. 1-3, the apron 160 may be substantially rectangular or trapezoidal in shape. The width of the apron 160 is at least as wide as the hips of an infant. The length of the apron 160 is at least as long as the legs of an infant, and may be double or triple the length of the legs of an infant.

Figure 7:
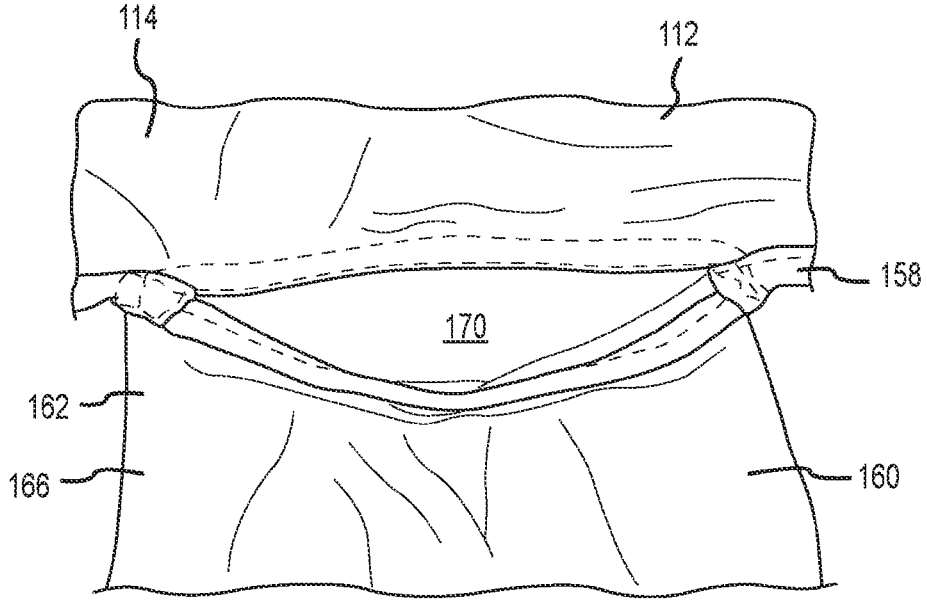
FIG. 7 is a front plan view of a pouch of the infant positioning swaddle of FIG. 1.

The apron 160 may be a flap or, as shown in FIG. 7, a pouch. An apron 160 that is a pouch includes an opening 170 through which the feet of an infant may be inserted.

The apron 160 may be constructed of any one or more soft fabric materials known in the art. The fabric material may be any material as described above for the swaddle blanket 110. The apron 160 may be constructed of the same fabric material as the swaddle blanket 110, or may be constructed of a different fabric material.

An apron 160 may be constructed from the same piece of fabric as the center section 112 of the swaddle blanket 110, or an apron may be permanently or releasably secured to the center section 112 at a juncture 108, which may be formed by any known means including, but not limited to, stitches, glue, tape, bonding, fasteners, or any combination thereof. A juncture 108 may include a seam.

The apron 160 of the exemplary embodiment includes an upper portion 162, lower portion 164, first surface 166, and second surface 168. The upper portion 162 may be positioned adjacent to the center section 112, and in between the center section 112 and the lower portion 164. With reference to FIG. 7, when the apron 160 is a pouch, the opening 170 may be between the first surface 166 and the second surface 168. The first surface 166 may form one side of the pouch and the second surface 168 may form another side of the pouch.

Figure 9:
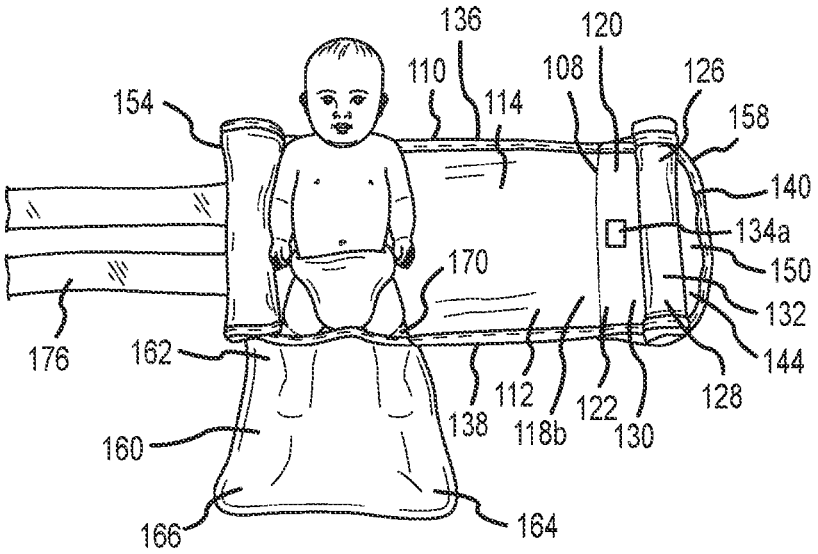
FIG. 9 is a front plan view of the infant positioning swaddle of FIG. 8 with one positioning member, wing, and flap in the rolled configuration.
Figure 10:
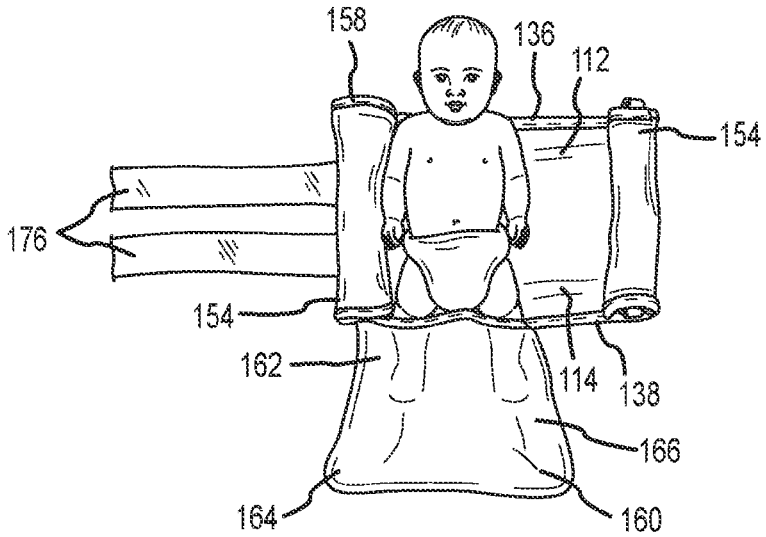
FIG. 10 is a front plan view of the infant positioning swaddle of FIG. 9 with the second positioning member, wing, and flap being rolled inward.

As shown in FIGS. 1-3, when the apron 160 is fully extended away from the swaddle blanket 110, the first surface 166 of the apron 160 faces the same direction as the front surface 114 of the center section 112 of the swaddle blanket 110, and the second surface 168 of the apron 160 faces the same direction as the back surface 116 of the center section 112 of the swaddle blanket 110. With reference to FIGS. 7 and 9, when the apron 160 is a pouch and an infant's feet have been inserted through the opening 170, at least a portion of the first surface 166 is positioned on top of the infant's feet or legs, and the infant's feet or legs rests on at least a portion of the second surface 168.

When in the extended position (see FIGS. 1-3), the apron 160 may lay substantially flat on the surface on which the positioning swaddle 100 is resting. When in the folded configuration (see FIGS. 11-14), the apron 160 may lay on itself or on the legs or torso of an infant. In the folded configuration, the apron 160 helps provide warmth and a sense of security to an infant. When in a rolled configuration (not shown), the apron 160 may be rolled toward and positioned at or near the bottom edge 138 of the center section 112. In the rolled configuration, the apron 160 helps support the legs and hips of the infant and promotes proper hip alignment.

Figure 31:
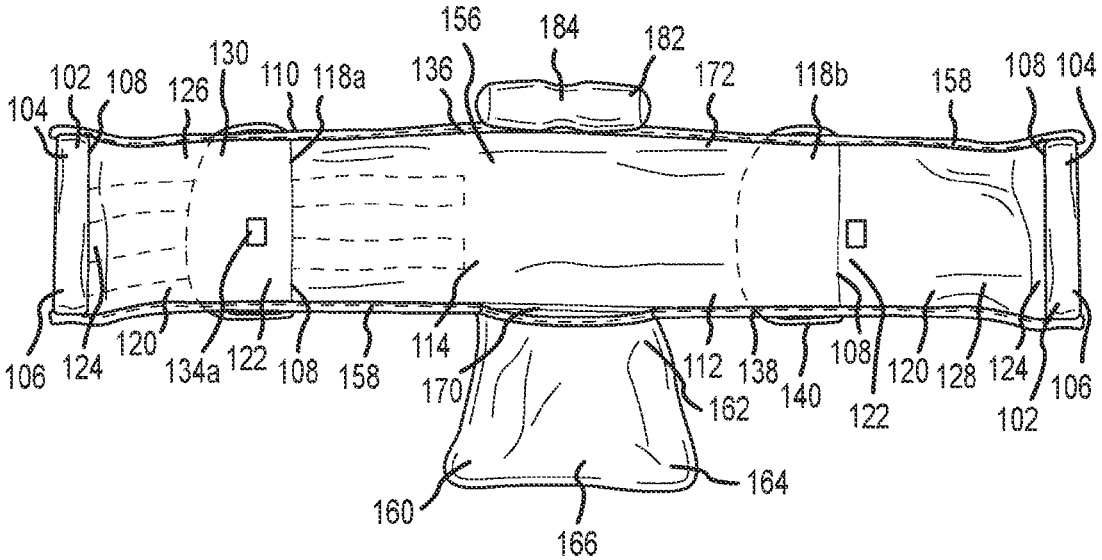
FIG. 31 is a front plan view of the infant positioning swaddle of FIG. 1 with a neck support roll.

In some implementations, the positioning swaddle 100 includes a neck support roll 182. With reference to FIG. 31, the neck support roll 182 may be substantially cylindrical in shape. The neck support roll 182 may have a length greater than its width (diameter).

A neck support roll 182 may have the same circumference along the entire length of the neck support roll 182, or the circumference may vary along the length of the neck support roll 182. A neck support roll 182 may include a depression 184 at or near the midpoint of its length such that the circumference of the neck support roll 182 is decreased at the depression 184. The depression 184 may be wide enough to accommodate an infant's neck. The depression 184 may be on one or more sides of the neck support roll 182. For example, the depression 184 may be on all sides of the neck support roll 182 such that it uniformly decreases the circumference of the neck support roll 182.

The neck support roll 182 may be comprised of a filler. The filler may be, for example, solid foam, memory foam, stuffing, batting, down, synthetic down-like material, gel, or a combination thereof. The filler may be resilient such that it returns to its original shape, or close to its original shape, after being compressed. The filler may be of sufficient quantity, compactness, or firmness that it resists complete compression by the weight of an infant's head or neck. The filler may be partially compressible, but has enough compression resistance that it helps the neck support roll 182 support an infant's head or neck. The compression resistance is effective at any weight of an infant's head.

The neck support roll 182 may include a casing, such as a fabric casing. The casing may completely or partially surround the filler. The casing may be constructed with one more seams.

A neck support roll 182 may be physically separate from but used in conjunction with the positioning swaddle 100. Alternatively, a neck support roll 182 may be permanently or releasably secured to the positioning swaddle 100. The neck support roll 182 may be secured at or near the top edge 136 of the center section 112 of the swaddle blanket 110. A swaddle blanket 110 may include a pocket or sleeve into which the neck support roll 182 is placed or removed to releasably secure the neck support roll 182. The neck support roll 182 may be secured to the swaddle blanket 110 by stitches, glue, tape, bonding, fasteners, or any combination thereof. Fasteners may include, for example, buttons, snaps, hook-and-loop fasteners, or hook-and-eye fasteners. By way of example, but not limitation, VELCRO® may be attached to part or all of the length of a neck support roll 182, and VELCRO® may be attached to part or all of the top edge 136 of the center section 112 of the swaddle blanket 110. The neck support roll 182 is thus releasably secured to the swaddle blanket 110 by engaging opposing VELCRO® pieces.

In the construction and use of a neck support roll 182, its size, shape, compressibility, and attachment to the swaddle blanket 110 help support an infant's head or neck, and help promote an open airway and uniform distribution of respiratory support to the lungs.

In some implementations, the positioning swaddle 100 includes a pillow pocket 190 configured to accommodate a pillow (not shown). A pillow aids in proper positioning of an infant and helps prevent plagiocephaly.

Figure 32:
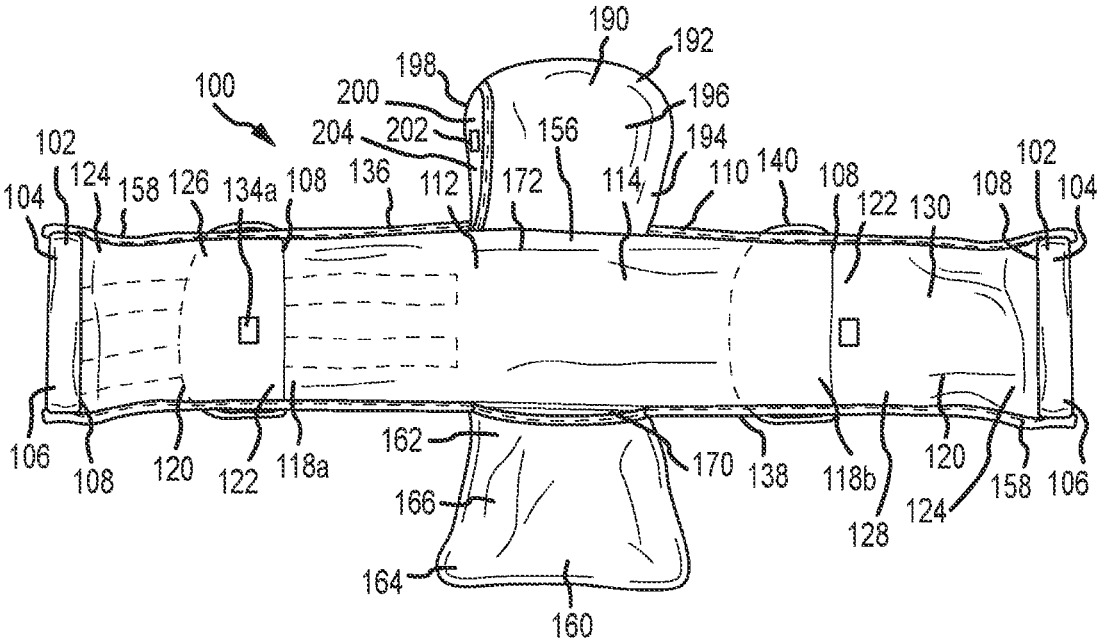
FIG. 32 is a front plan view of an infant positioning swaddle of FIG. 1 with a pillow pocket.

With reference to FIG. 32, a pillow pocket 190 may be positioned near or at the top edge 136 of the center section 112 and may be centered at or near the center 156 of the center section 112. The pillow pocket 190 may be substantially circular in shape, or may be substantially rectangular. The pillow pocket 190 is large enough to receive a pillow, such as a gel pillow, for infant positioning. The pillow pocket 190 of the exemplary embodiment includes an upper portion 192, lower portion 194, first surface 196, and second surface 198. The lower portion 194 may be positioned adjacent to the center section 112, and in between the center section 112 and the upper portion 192.

The pillow pocket 190 includes an opening 200 through which a pillow may be inserted. The opening 200 may be positioned such that it is easy and convenient for a nurse to insert a pillow through the opening 200 while a team of medical professionals is tending to an infant. For example, and as shown in FIG. 32, the opening 200 may be positioned along the left edge 204 of the pillow pocket 190. In a standard arrangement of medical professionals tending to a medically unstable infant, a doctor stands at the head of the infant and a nurse stands to the right side of the doctor and the infant. Positioning the opening 200 in front of the nurse on the right side of the infant (the left edge 204 of the pillow pocket 190) enables the nurse to quickly and easily insert or remove a pillow without interfering with the activities of other professionals.

The opening 200 may extend from at or near the upper portion 192 of the pocket 190 to at or near the lower portion 194 of the pocket 190. The opening 200 may be between the first surface 196 and the second surface 198. The first surface 196 may form one side of the pocket 190 and the second surface 198 may form another side of the pocket 190. The opening 200 may include a fastener 202 for releasably securing the pillow within the pillow pocket 190. The fastener 202 may be a button-and-hole, snap, hook-and-loop fastener (e.g. VELCRO®), or hook-and-eye fastener.

The pillow pocket 190 may be constructed of any one or more soft fabric materials known in the art. The fabric material may be any material as described above for the swaddle blanket 110. The pillow pocket 190 may be constructed of the same fabric material as the swaddle blanket 110, or may be constructed of a different fabric material.

A pillow pocket 190 may be constructed from the same piece of fabric as the center section 112 of the swaddle blanket 110, or a pillow pocket 190 may be permanently or releasably secured to the center section 112 at a juncture 108, which may be formed by any known means including, but not limited to, stitches, glue, tape, bonding, fasteners, or any combination thereof. A juncture 108 may include a seam.

As shown in FIG. 32, when the pillow pocket 190 is fully extended away from the swaddle blanket 110, the first surface 196 of the pillow pocket 190 faces the same direction as the front surface 114 of the center section 112 of the swaddle blanket 110, and the second surface 198 of the pillow pocket 190 faces the same direction as the back surface 116 of the center section 112 of the swaddle blanket 110.

When a pillow is inserted through the opening 200, it is positioned between the first surface 196 and the second surface 198. When a pillow is not inserted in the pillow pocket 190, the pillow pocket 190 may lay substantially flat on the surface on which the positioning swaddle 100 is resting. In another implementation, the pillow pocket 190 is folded behind the swaddle blanket 110 such that the second surface 198 is adjacent to the back surface 116 of the swaddle blanket 110.

In some implementations, the positioning swaddle 100 includes a leg support roll (not shown). The leg support roll may be substantially cylindrical in shape. The leg support roll may have a length greater than its width (diameter).

A leg support roll may have the same circumference along its entire length, or the circumference may vary, e.g., taper or expand along its length. A leg support roll may include one or more depressions such that the circumference of the leg support roll is decreased at each depression. The depressions may be wide enough to accommodate an infant's legs. The depressions may be on one or more sides of the leg support roll. For example, the depressions may be on all sides of the leg support roll such that they uniformly decrease the circumference of the leg support roll.

The leg support roll may be comprised of a filler. The filler may be, for example, solid foam, memory foam, stuffing, batting, down, synthetic down-like material, gel, or a combination thereof. The filler may be resilient such that it returns to its original shape, or close to its original shape, after being compressed. The filler may be of sufficient quantity, compactness, or firmness that it resists complete compression by the weight of an infant's legs. The filler may be partially compressible, but has enough compression resistance that it helps the leg support roll support an infant's legs or hips. The compression resistance is effective at any weight of an infant's legs.

The leg support roll may include a casing, such as a fabric casing. The casing may completely or partially surround the filler. The casing may be constructed with one more seams.

A leg support roll may be physically separate from but used in conjunction with the positioning swaddle 100. Alternatively, a leg support roll may be permanently or releasably secured to the positioning swaddle 100. The leg support roll may be secured at or near the bottom edge 138 of the center section 112 of the swaddle blanket 110. A swaddle blanket 110 may include a pocket or sleeve into which the leg support roll is placed or removed to releasably secure the leg support roll. The leg support roll may be secured to the swaddle blanket 110 by stitches, glue, tape, bonding, fasteners, or any combination thereof. Fasteners may include, for example, buttons, snaps, hook-and-loop fasteners, or hook-and-eye fasteners. By way of example, but not limitation, VELCRO® may be attached to part or all of the length of a leg support roll, and VELCRO® may be attached to part or all of the bottom edge 138 of the center section 112 of the swaddle blanket 110. The leg support roll is thus releasably secured to the swaddle blanket 110 by engaging opposing VELCRO® pieces.

In the construction and use of a leg support roll, its size, shape, compressibility, and attachment to the swaddle blanket 110 help support an infant's legs or hips, and aids in optimal body positioning for proper hip alignment and CNS development.

In some implementations, the positioning swaddle 100 includes a pad pocket 210 configured to accommodate a heating or cooling pad (not shown). A heating or cooling pad aids in regulating the temperature of an infant and can help minimize or prevent medical complications associated with premature or stressful birth.

Figure 33:
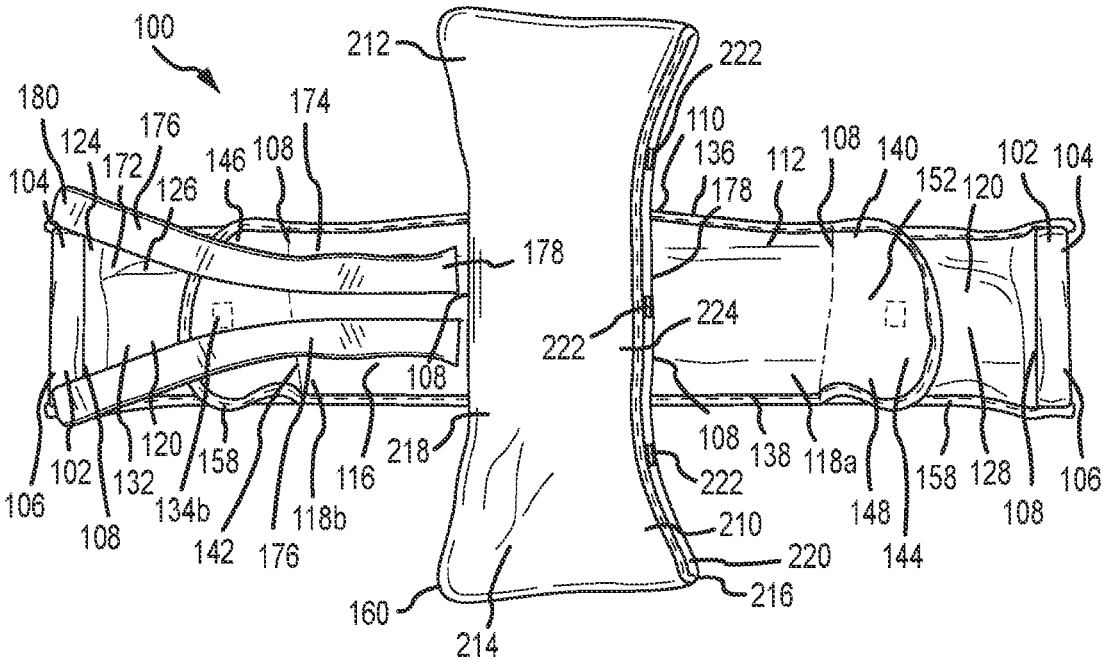
FIG. 33 is a rear plan view of an infant positioning swaddle of FIG. 1 with a pad pocket.

With reference to FIG. 33, a pad pocket 210 may be positioned on or be integrated with the back surface 116 of the center section 112 and may be centered around the center 156 of the center section 112. The pad pocket 210 may be substantially rectangular in shape. The width and length of the pad pocket 210 is at least wide and long enough, respectively, to receive a heating or cooling pad.

The pad pocket 210 includes an opening 220 through which a pad may be inserted. The opening 220 may be positioned such that it is easy and convenient for a nurse to insert a pad through the opening 220 while a team of medical professionals is tending to an infant. For example, and as shown in FIG. 33, the opening 220 may be positioned along the left edge 224 of the pad pocket 210. In the standard arrangement of medical professionals tending to a medically unstable infant, a doctor stands at the head of the infant and a nurse stands to the right side of the doctor and the infant. Positioning the opening 220 in front of the nurse on the right side of the infant (the left edge 224 of the pad pocket 210) enables the nurse to quickly and easily insert or remove a pad without interfering with the activities of other professionals.

The opening 220 may include at least one fastener 222 for releasably securing the pad within the pad pocket 210. Each fastener 222 may be a button-and-hole, snap, hook-and-loop fastener (e.g. VELCRO®), or hook-and-eye fastener.

The pad pocket 210 may be constructed of any one or more soft fabric materials known in the art. The fabric material may be any material as described above for the swaddle blanket 110. The pad pocket 210 may be constructed of the same fabric material as the swaddle blanket 110, or may be constructed of a different fabric material.

A pad pocket 210 may be constructed from the same piece of fabric as the center section 112 of the swaddle blanket 110 and/or an apron 160, or a pad pocket 210 may be permanently or releasably secured to the center section 112 and/or an apron 160 at one or more junctures 108, which may be formed by any known means including, but not limited to, stitches, glue, tape, bonding, fasteners, or any combination thereof. A juncture 108 may include a seam. In some embodiments, a pillow pocket 190 is provided with a pad pocket 210, and the pad pocket 210 may be constructed from the same piece of fabric as the pillow pocket 190, or the pad pocket 210 may be permanently or releasably secured to the pillow pocket at one or more junctures 108.

The pad pocket 210 of the exemplary embodiment includes an upper portion 212, lower portion 214, first surface 216, and second surface 218. The lower portion 214 may be positioned opposite the lower portion 164 of an apron 160. The upper portion 212 may be positioned beyond the top edge 136 of the center section 112. In some embodiments, both the pillow pocket 190 and the pad pocket 210 may be provided and the pad pocket 210 may be positioned below the pillow pocket 190. The opening 220 may be between the first surface 216 and the second surface 218. The first surface 216 may form one side of the pocket 210 and the second surface 218 may form another side of the pocket 210. The first surface 216 may be adjacent to or integral with the back surface 116 of the center section 112 and/or with the second surface 168 of the apron 160. When a pillow pocket 190 is provided with the pad pocket 210, the first surface 216 may be adjacent to or integral with the second surface 198 of the pillow pocket 190.

When a pad is inserted through the opening 220, it is positioned between the first surface 216 and the second surface 218 such that one end of the pad is positioned at or adjacent to the upper portion 212 of the pad pocket 210, and the opposite end of the pad is positioned at or adjacent to the lower portion 214 of the pad pocket 210. When a pad is not inserted in the pad pocket 210, the pad pocket 210 may lay substantially flat on the surface on which the positioning swaddle 100 is resting.

Positioning Swaddle Kits

The positioning swaddle 100 of FIGS. 1-30 may be provided as part of a kit. The kit may also include a neck support roll 182, a pillow, a leg support roll, a heating and/or cooling pad, and/or a bag in which at least the positioning swaddle 100 can be stored or laundered. The bag may be a mesh or net fabric bag. That is, the kit may include one or more accessories that may be used in conjunction with the positioning swaddle 100 (e.g., at the same time and/or coupled to the positioning swaddle) and/or that may be used as part of a holistic comfort regiment for providing comfort for infants. For example, accessories, such as headbands, hats, eye covers, or the like, may be included in the kit and/or configured to couple to various aspects of the positioning swaddle.

Methods of Use of the Positioning Swaddle: Supine Positioning

By way of example, but not limitation, the positioning swaddle 100 of FIGS. 1-14 may be used to support an infant in a supine position according to the following procedure. The positioning swaddle 100 is placed on a surface such that at least the back surface 116 of the center section 112 is relatively flat against the surface on which it has been placed. None of the positioning rolls 102, wings 120, flaps 140, or free ends 180 of the securing straps 176 are positioned between the back surface 116 of the center 156 of the center section 112 and the surface on which the center section 112 is resting. If an apron 160 is provided, it may be fully extended as shown in FIGS. 1-3. One or both of the wings 120 may be fully laterally extended as shown in FIG. 3.

An infant is placed in the supine position on the front surface 114 of the center section 112. The infant is placed approximately in the horizontal center 156 of the center section 112, as shown in FIG. 8. The neck of the infant is positioned near the top edge 136 of the center section 112. The legs of the infant may extend past the bottom edge 138 of the center section 112.

In another embodiment, the positioning swaddle 100 can be slid down the back of the head and body of an infant that is already in the supine position, which minimizes disturbance to and stress on the infant. The infant is positioned on the center section 112 as described in the preceding procedure.

When an apron 160 is provided, the feet and legs of the infant may rest on the first surface 166 of the apron 160, as shown in FIG. 8. In another embodiment, and when the apron 160 is a pouch, an infant's feet are inserted through an opening 170 in the apron 160. The feet and legs may be positioned in the upper portion 162 of the apron 160 (see FIG. 9), or may extend into the lower portion 164 (not shown).

As shown in FIGS. 5 and 6, a positioning roll 102 is rolled toward the juncture 108 between the flap 140 and wing 120 adjacent to the positioning roll 102. The adjacent wing 120 is wrapped around the positioning roll 102 from the distal end 124 to the proximal end 122 of the wing 120. The second surface 132 of the wing 120 is positioned on the interior of the roll and the first surface 130 of the wing 120 is positioned on the exterior of the roll. When the positioning roll 102 and wing 120 are fully rolled up, the first surface 130 of the wing 120 is positioned adjacent to the first surface 150 of the adjacent flap 140. The flap 140 is then secured to the rolled-up wing 120 by pressing together the VELCRO® fastener 134*a* on the first surface 130 of the proximal end 122 of the wing 120 and the VELCRO® fastener 134*b* on the first surface 150 of the distal end 144 of the flap 140. As shown in FIG. 6, fastening the fasteners 134*a*, 134*b* secures the positioning roll 102, wing 120, and flap 140 in the fully rolled configuration (positioning wrap 154).

In another embodiment, as shown in FIG. 9, a positioning roll 102 is rolled toward the center section 112, which rolls the adjacent wing 120 around the positioning roll 102 from the distal end 124 to the proximal end 122 of the wing 120. The first surface 130 of the wing 120 is positioned on the interior of the roll and the second surface 132 of the wing 120 is positioned on the exterior of the roll. The distal end 144 of the flap 140 is rolled in line with the wing 120. When the positioning roll 102 and the wing 120 are fully rolled up, the second surface 132 of the wing 120 is positioned adjacent to the first surface 150 of the adjacent flap 140. The second surface 152 of the flap 140 is the outer surface of the positioning wrap 154. The flap 140 may be secured to the rolled-up wing 120 by being wrapped around the wing 120. In another embodiment, the flap 140 is secured to the rolled-up wing 120 by pressing together a VELCRO® fastener (not shown) on the second surface 132 of the wing 120 and a VELCRO® fastener (not shown) on the first surface 150 of the flap 140.

For any of the preceding embodiments, each positioning wrap 154 is rolled towards the center 156 of the center section 112 of the swaddle blanket 112 (see FIG. 10) until the positioning wrap 154 is adjacent to the infant. At least the lateral end 118*a*, 118*b* of the center section 112 may also be wrapped around the positioning wrap 154. The positioning wraps 154 may be adjacent to the infant's arm that has been positioned alongside its torso (see FIG. 11). The positioning wraps 154 maintain the infant in the supine position and prevent the infant from rolling away from the supine position.

Each positioning wrap 154 may be rolled in toward the center 156 of the center section 112 more or less to accommodate different sizes of infants. For smaller or narrower infants, one or both of the positioning wraps 154 are rolled in closer to the center 156 of the center section 112 than for larger or wider infants. Each positioning wrap 154 can be rolled or unrolled at any time to provide a tighter or looser fit, respectively. The positioning swaddle 100 is therefore fully adjustable, can accommodate any size of infant, and can accommodate any given infant as the infant grows over time.

Figure 12:
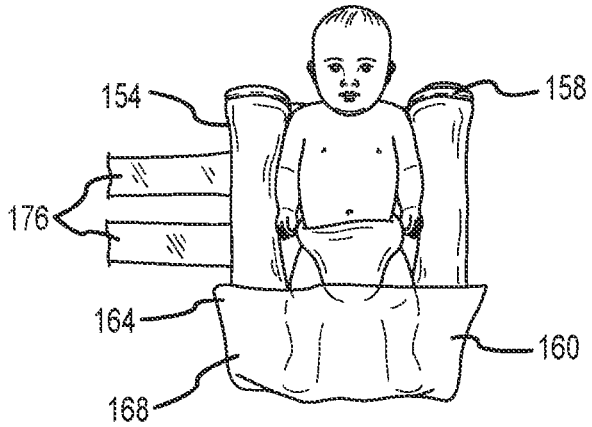
FIG. 12 is a front plan view of the infant positioning swaddle of FIG. 11 with the apron folded up.

With reference to FIG. 12, if an apron 160 is provided, the lower portion 164 of the apron 160 may be folded towards the torso of the infant. The first surface 166 of the apron 160 faces the torso and the second surface 168 faces outward. In another embodiment, the apron 160 is folded towards the torso of an infant before the positioning wraps 154 have been placed alongside the infant. In another embodiment, the feet and legs of the infant rest on the first surface 166 of the apron 160 (see FIG. 8), and the apron 160 is folded over them. In any of the preceding embodiments, the apron 160 provides warmth and a sense of security to the infant.

In another embodiment (not shown), the apron 160 is rolled toward the center section 112 of the swaddle blanket 110 from the lower portion 164 to the upper portion 162 of the apron 160. The infant's legs are placed on the rolled apron 160, which provides support for the legs or hips of the infant and aids in optimal body positioning for proper hip alignment and CNS development.

Figure 13:
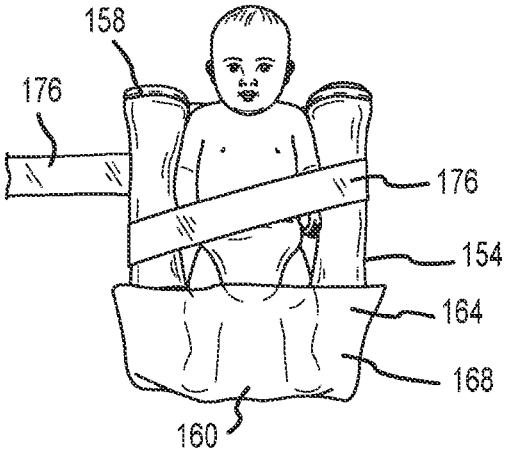
FIG. 13 is a front plan view of the infant positioning swaddle of FIG. 12 with one securing strap secured.
Figure 14:
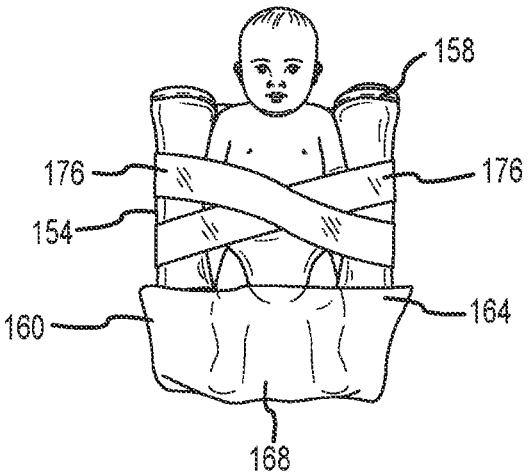
FIG. 14 is a front plan view of the infant positioning swaddle of FIG. 13 with the second securing strap secured.

For any of the preceding embodiments, and as shown in FIGS. 13 and 14, a securing strap 176 is drawn around a positioning wrap 154, across the torso of the infant, and the free end 180 is tucked under the opposing positioning wrap 154. The securing strap 176 can be guided over or around any already placed medical devices, which minimizes disturbance to them and the infant, and minimizes stress on the infant. One securing strap 176 may be used (see FIG. 13) or both securing straps 176 may be used (see FIG. 14) in a crossed configuration or in a parallel configuration (not shown). Use of one or both securing straps 176 secures the positioning swaddle 100 to the infant, helps maintain the infant in the supine position, helps resist the infant rolling away from the supine position, maintains the infant's arms in the optimal body position for proper CNS development, prevents the infant's arms or hands from interfering with medical devices placed in or on torso, and provides a sense of security to the infant. The securing straps 176 can be loosened, released, or moved at any time to permit easy access to the torso for placement, removal, or monitoring of medical devices.

The positioning swaddle 100 of the embodiments depicted in FIGS. 1-14 may include a neck support roll 182 as depicted in FIG. 31. By way of example, but not limitation, a positioning swaddle 100 may be used with a neck support roll 182 to support an infant in a supine position, as well as to support the neck of an infant and promote an open airway, according to the following procedure.

The positioning swaddle 100 may be positioned according to any method described herein. The neck support roll 182 may already be attached to the swaddle blanket 110, or it may be slid behind the neck of an infant after the positioning swaddle 100 has been positioned. The neck of the infant rests on the depression 184 in the neck support roll 182. The neck support roll 182 helps support an infant's head or neck. The neck support roll 182 also helps promote an open airway and uniform distribution of respiratory support to the lungs, such as when an infant is on a ventilator.

The positioning swaddle 100 of the embodiments depicted in FIGS. 1-14 may include a pillow pocket 190 as depicted in FIG. 32. By way of example, but not limitation, a pillow may be inserted into a pillow pocket 190 of a positioning swaddle 100 to support the head or neck of an infant in a position that prevents plagiocephaly, according to the following procedure.

The positioning swaddle 100 may be positioned according to any method described herein. A pillow may already be inserted into the pillow pocket 190 between the first surface 196 and second surface 198, or a pillow may be slid behind the head of an infant after the positioning swaddle 100 with the pillow pocket 190 has been positioned. A nurse standing to the right of a doctor standing at the head of the infant can quickly and easily insert a pillow through the opening 200 without disturbing the doctor or other medical professionals who are concurrently providing care to the infant.

The pillow may be secured inside the pocket 190 by engaging a fastener 202, such as by pressing together opposing pieces of VELCRO®. The pillow in the pillow pocket 190 helps support an infant's head or neck and helps prevent plagiocephaly. The pillow pocket 190 helps prevent the pillow from shifting out of position.

The positioning swaddle 100 of the embodiments depicted in FIGS. 1-14 may include a leg support roll (not shown). By way of example, but not limitation, a positioning swaddle 100 may be used with a leg support roll to support an infant in a supine position, as well as to support the legs or hips of an infant, according to the following procedure.

The positioning swaddle 100 may be positioned according to any method described herein. The leg support roll may already be attached to the swaddle blanket 110, or it may be slid behind the legs of an infant after the positioning swaddle 100 has been positioned. The backs of the knees of the infant rest on the leg support roll. The leg support roll helps support the legs or hips of the infant and aids in optimal body positioning for proper hip alignment and CNS development.

Methods of Use of the Positioning Swaddle: Side Positioning

By way of example, but not limitation, the positioning swaddle 100 of FIGS. 1-7 may be used to support an infant in a side-lying position according to the following procedure.

The positioning swaddle 100 is placed on a surface according to the procedure described above. An infant is placed on its side on the front surface 114 of the center section 112. The infant is placed approximately in the horizontal center 156 of the center section 112, as shown in FIG. 8. The neck of the infant is positioned near top edge 136 of the center section 112. The legs of the infant may extend past the bottom edge 138 of the center section 112.

In another embodiment, the positioning swaddle 100 can be slid down the side of the head and body of an infant that is already in the side-lying position, which minimizes disturbance to and stress on the infant. The infant is positioned on the center section 112 as described in the preceding procedure.

Each positioning roll 102 is rolled with the adjacent wing 120 and flap 140 to form a positioning wrap 154 as described above. Each positioning wrap 154 is rolled towards the center 156 of the center section 112 of the swaddle blanket 112 until the positioning wrap 154 is adjacent to the infant. One positioning wrap 154 is positioned adjacent to the front of the torso of the infant, and the other positioning wrap 154 is positioned adjacent to the back of the torso of the infant. The positioning wraps 154 maintain the infant in the side-lying position and prevent the infant from rolling away from the side-lying position. All other aspects of using the positioning swaddle 100 are the same as described above.

Methods of Use of the Positioning Swaddle: Temperature Regulation

By way of example, but not limitation, the positioning swaddle 100 of FIGS. 1-14 and 33 may be used to help regulate an infant's body temperature according to the following procedure. The positioning swaddle 100 may be positioned according to any of the methods described herein for supine positioning of an infant. One or both of the positioning wraps 154 may be positioned adjacent to the infant according to any of the methods described herein for supine positioning.

A heating or cooling pad may already be inserted into the pad pocket 210 between the first surface 216 and second surface 218, or the pad may be slid behind the torso, legs, and/or head of an infant and into the pad pocket 210. A nurse standing to the right of a doctor standing at the head of the infant can quickly and easily insert a pad through the opening 220 without disturbing the doctor or other medical professionals who are concurrently providing care to the infant.

The pad may be secured inside the pocket 210 by engaging the one or more fasteners 222, such as by pressing together opposing pieces of VELCRO®. At least the torso of the infant rests on the center section 112 under which the pad is positioned. The front surface 114 of the center section 112 and/or the first surface 216 of the pad pocket 210 may form a non-insulating fabric barrier between the pad and the infant.

The pad may be inserted or removed at any time while the positioning swaddle 100 is in use. The pad helps to regulate the temperature of an infant, such as to warm up or keep warm an infant that is not maintaining a high enough body temperature, or to cool down or keep cool an infant who may benefit from induced hypothermia.

Methods of Use of the Positioning Swaddle: Swaddling

By way of example, but not limitation, the positioning swaddle 100 of FIGS. 1-4, 7 and 15-27 may be used to swaddle an infant according to the following procedure. The positioning swaddle 100 is placed on a surface such that at least the back surface 116 of the center section 112 is relatively flat against the surface on which it has been placed. None of the positioning rolls 102, wings 120, flaps 140, or securing straps 176 are positioned between the back surface 116 of the center 156 of the center section 112 and the surface on which the center section 112 is resting. If an apron 160 is provided, it is not positioned under or on top of the center section 112. Some or all of the flaps 140 and wings 120 may be fully laterally extended as shown in FIG. 16.

An infant is placed in the supine position on the front surface 114 of the center section 112. The infant is placed approximately in the horizontal center 156 of the center section 112, as shown in FIG. 16, with its arms alongside its torso. The neck of the infant is positioned near top edge 136 of the center section 112. The legs of the infant may extend past the bottom edge 138 of the center section 112.

In another embodiment, the positioning swaddle 100 can be slid down the back of the head and body of an infant that is already in the supine position, which minimizes disturbance to and stress on the infant. The infant is positioned on the center section 112 as described in the preceding procedure.

When an apron 160 is provided, the feet and legs of the infant may rest on the first surface 166 of the apron 160. In another embodiment, and when the apron 160 is a pouch, an infant's feet are inserted through an opening 170 in the apron 160. The feet and legs may be positioned in the upper portion 162 of the apron 160 (see FIG. 9), or may extend into the lower portion 164 (not shown).

As shown in FIG. 16, a positioning roll 102 is drawn towards the infant, thereby drawing the adjacent wing 120 along the center section 112 of the swaddle blanket 110. The wing 120 is pulled taught such that the first surface 130 of the wing 120 lies substantially flat against the front surface 114 of the center section 112. The positioning roll 102 is then rolled away from the infant, which rolls the distal end 124 of the wing 120 around the positioning roll 102, until the partially rolled positioning roll 102 is positioned on the swaddle blanket 110 adjacent to the infant.

Figure 17:
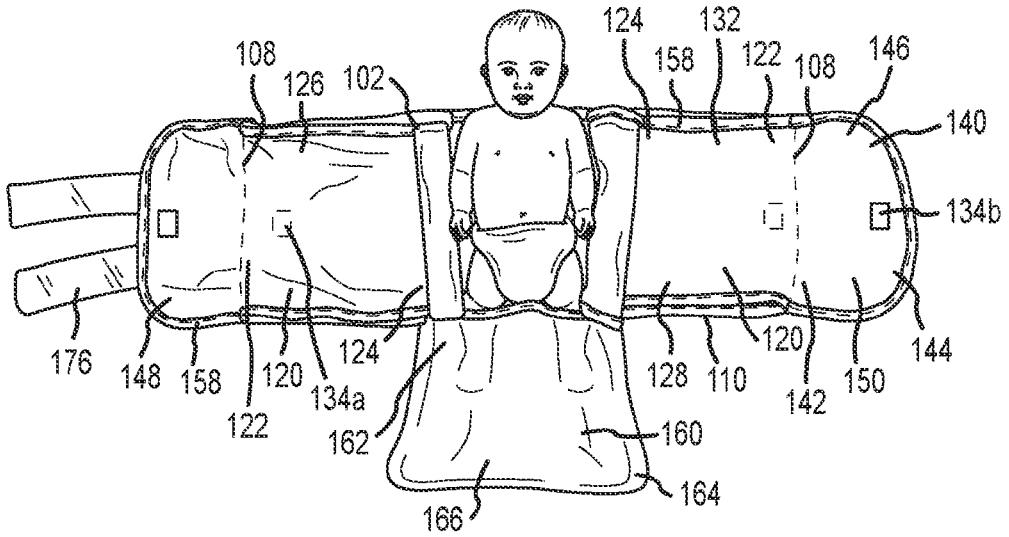
FIG. 17 is a front plan view of the infant positioning swaddle of FIG. 16 with the second positioning roll in the partially rolled configuration.

Simultaneously or sequentially, the second positioning roll 102 is also positioned adjacent to the infant, as shown in FIG. 17, according to the preceding procedure. The positioning rolls 102 may be adjacent to the infant's arms that have been positioned alongside its torso. The positioning rolls 102 provide lateral support and a sense of security to the infant.

Each positioning roll 102 may be rolled away from the center 156 of the center section 112 more or less to accommodate different sizes of infants. For larger or wider infants, one or both of the positioning rolls 102 are rolled away from the center 156 of the center section 112 more than for smaller or narrower infants. Each positioning roll 102 can be unrolled or rolled at any time to provide a tighter or looser fit, respectively. The positioning swaddle 100 is therefore fully adjustable, can accommodate any size of infant, and can accommodate any given infant as the infant grows over time.

In contrast to the methods for supine positioning of an infant described above, in which greater rolling up of a positioning roll 102 and adjacent wing 120 produces a tighter fit of the positioning swaddle 100 on the infant, rolling a positioning roll 102 and adjacent wing 120 in a method for swaddling an infant produces a looser fit of the positioning swaddle 100.

Figure 18:
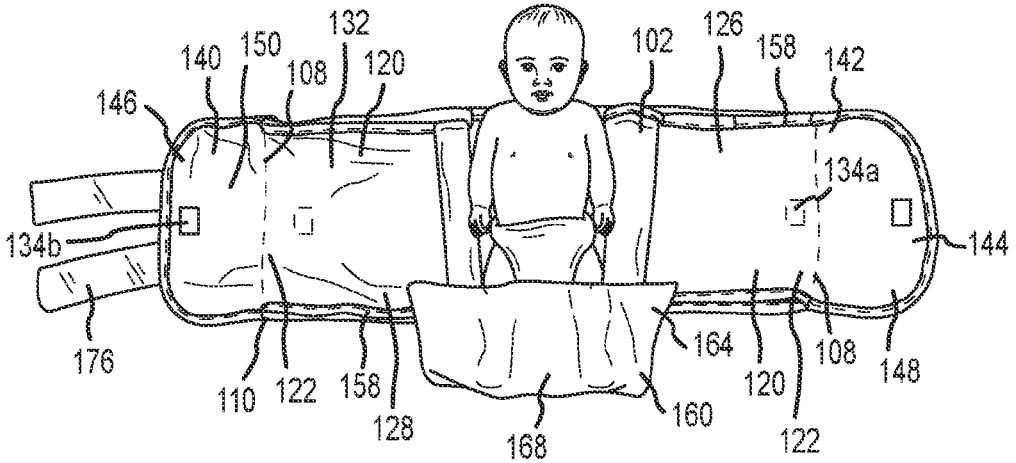
FIG. 18 is a front plan view of the infant positioning swaddle of FIG. 17 with the apron folded up.

With reference to FIG. 18, if an apron 160 is provided, the lower portion 164 of the apron 160 may be folded towards the torso of the infant. The first surface 166 of the apron 160 faces the torso and the second surface 168 faces outward. In another embodiment, the apron 160 is folded towards the torso of an infant before the positioning rolls 102 have been placed alongside the infant. In another embodiment, the feet and legs of the infant rest on the first surface 166 of the apron 160, and the apron 160 is folded over them. In any of the preceding embodiments, the apron 160 provides warmth and a sense of security to the infant.

In another embodiment (not shown), the apron 160 is rolled toward the center section 112 of the swaddle blanket 110 from the lower portion 164 to the upper portion 162 of the apron 160. The infant's legs are placed on the rolled apron 160, which provides support for the legs or hips of the infant and aids in optimal body positioning for proper hip alignment and CNS development.

Figure 19:
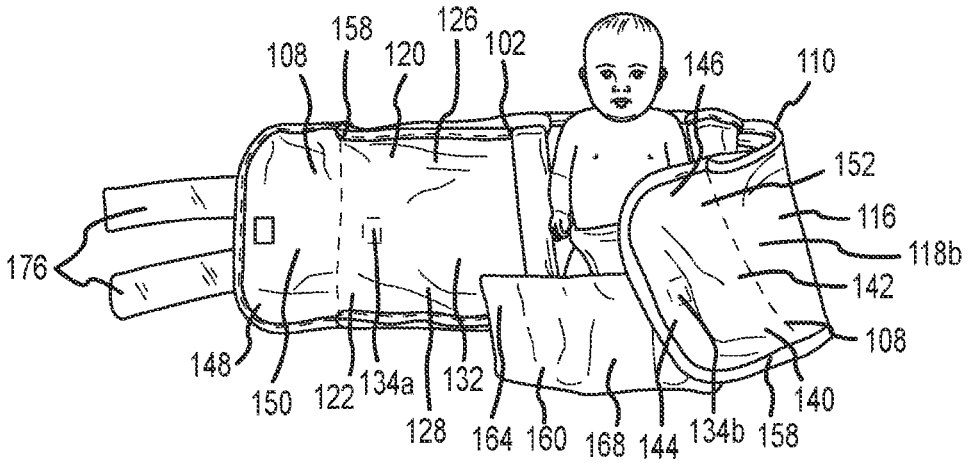
FIG. 19 is a front plan view of the infant positioning swaddle of FIG. 18 with one flap and wing being folded across the infant.
Figure 20:
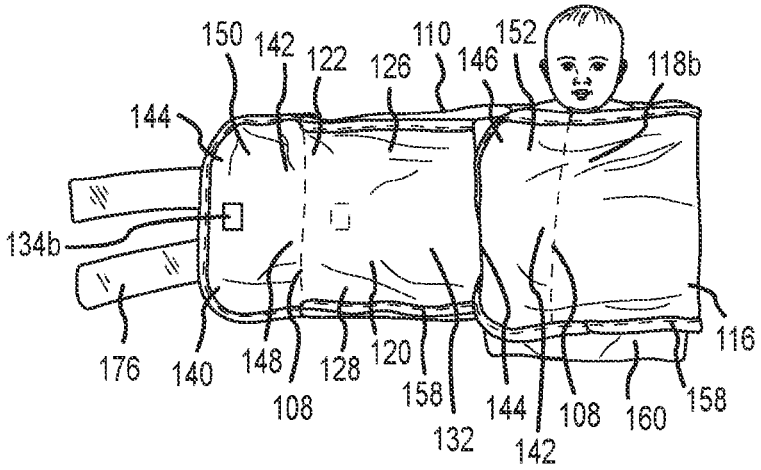
FIG. 20 is a front plan view of the infant positioning swaddle of FIG. 19 with one flap and wing swaddled across an infant.

For any of the preceding embodiments, and as shown in FIG. 19, next a flap 140 is drawn taught across the torso of the infant by pulling on the distal end 144 of the flap 140, which also draws on the attached wing 120 and center section 112. The distal end 144 of the flap 140 is then tucked around and under the positioning roll 120 on the opposing side of the positioning swaddle 100, as shown in FIG. 20. The second surface 152 of the flap 140 and the back surface 116 of center section 112 face outward, while the second surface 132 of the wing 120 faces the torso of the infant.

Figure 21:
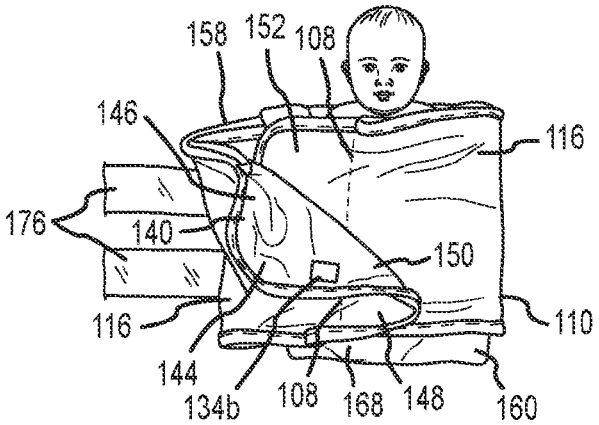
FIG. 21 is a front plan view of the infant positioning swaddle of FIG. 20 with the second flap and wing being folded across the infant.
Figure 22:
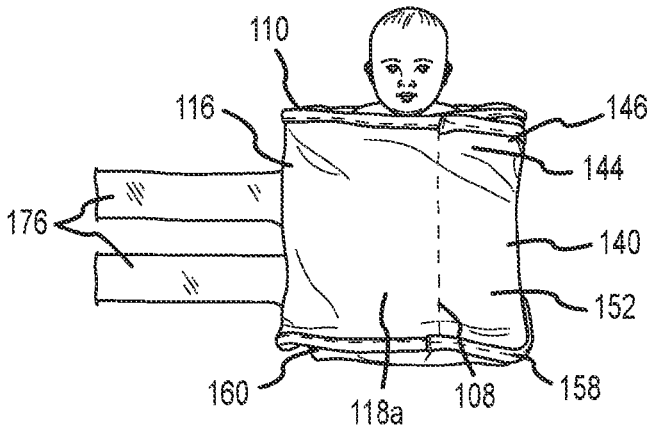
FIG. 22 is a front plan view of the infant positioning swaddle of FIG. 21 with the second flap and wing swaddled across an infant.

The second flap 140 is then drawn taught across the second surface 152 of the opposing flap 140 and the back surface 116 of the center section 112, as shown in FIG. 21. The distal end 144 of the flap 140 is then tucked around and under the center section 112 covering the positioning roll 120 on the opposing side of the positioning swaddle 100, as shown in FIGS. 22 and 27.

Figure 23:
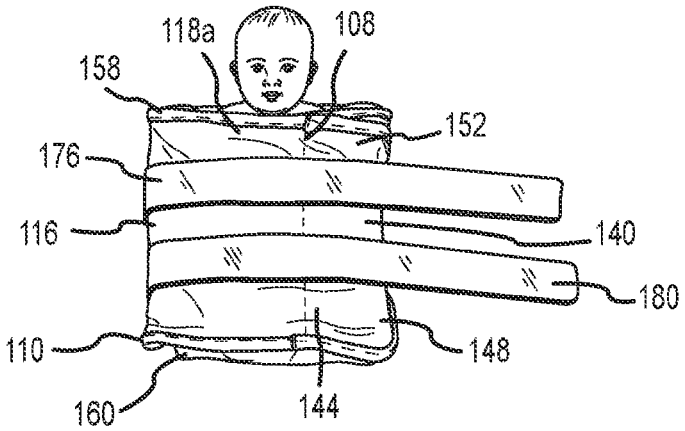
FIG. 23 is a front plan view of the infant positioning swaddle of FIG. 22 with the securing straps being positioned across an infant.
Figure 24:
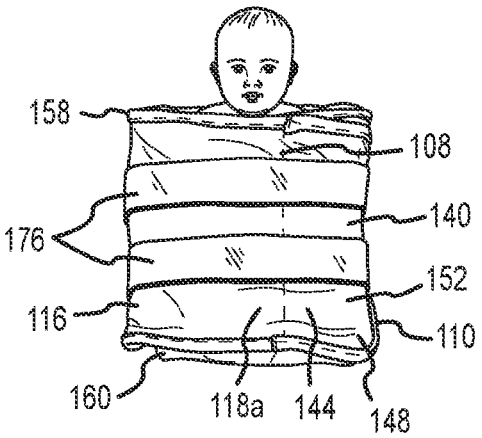
FIG. 24 is a front plan view of the infant positioning swaddle of FIG. 23 with the securing straps securing a swaddled infant.
Figure 25:
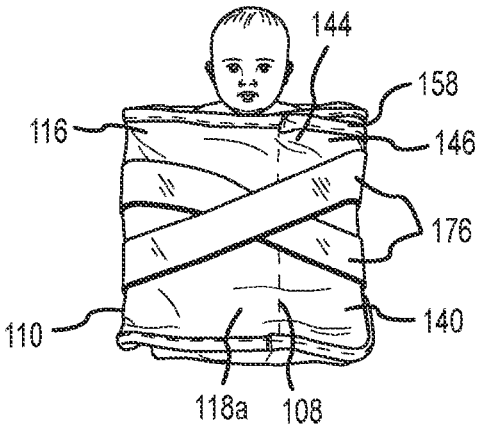
FIG. 25 is a front plan view of the infant positioning swaddle of FIG. 22 with the securing straps securing, in an alternative configuration, a swaddled infant.
Figure 26:
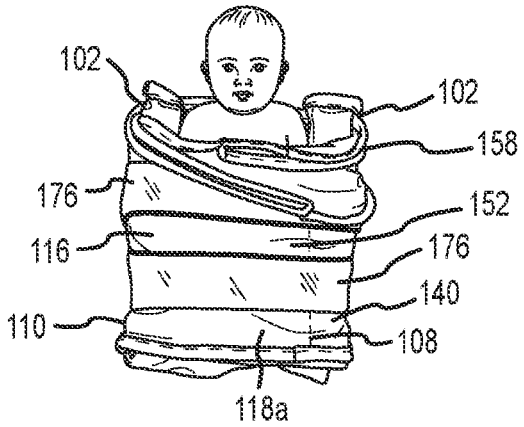
FIG. 26 is a front plan view of the infant positioning swaddle of FIG. 24 with the swaddle blanket turned down to reveal the positioning members.
Figure 27:
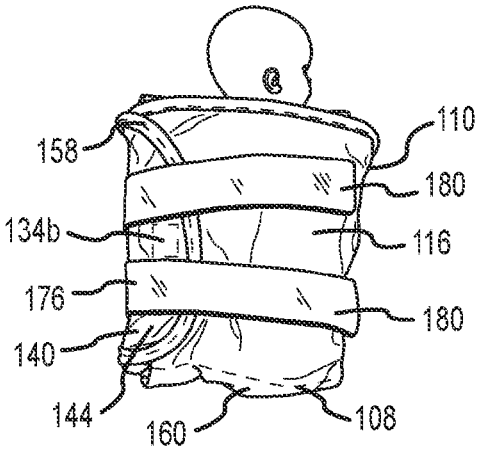
FIG. 27 is a rear plan view of the infant positioning swaddle of FIG. 24.

One or both securing straps 176 are then drawn across the swaddled torso of the infant as shown in FIG. 23, and the free ends 180 are tucked under the opposing covered positioning roll 102 or under the swaddled back of the infant (see FIG. 27). The securing straps 176 may be positioned parallel to each other (see FIG. 24) or in a crossed configuration (see FIG. 25).

Use of one or both securing straps 176 secures the positioning swaddle 100 to the infant, helps maintain the infant in the supine position, helps resist the infant rolling away from the supine position, maintains the infant's arms in the optimal body position for proper CNS development, and provides a sense of security to the infant.

Swaddling an infant using the positioning swaddle 100 soothes the infant and helps an infant to fall asleep and remain asleep. Also, when an infant has been positioned in the supine position according to procedures described above, swaddling the infant in the same positioning swaddle 100 minimizes stress on and disturbance to the infant because the infant does not have to be moved from one device to another. Instead, the same positioning swaddle 100 is used for both supine positioning and swaddling.

The positioning swaddle 100 of the embodiments depicted in FIGS. 1-4, 7 and 15-27 may include a neck support roll 182 as depicted in FIG. 31. By way of example, but not limitation, a positioning swaddle 100 may be used with a neck support roll 182 to swaddle an infant, as well as to support the neck of an infant and promote an open airway, according to the following procedure.

The positioning swaddle 100 may be positioned according to any method described herein. The neck support roll 182 may already be attached to the swaddle blanket 110, or it may be slid behind the neck of an infant after the positioning swaddle 100 has been positioned. The neck of the infant rests on the depression 184 in the neck support roll 182. The neck support roll 182 helps support an infant's head or neck. The neck support roll 182 also helps promote an open airway and uniform distribution of respiratory support to the lungs, such as when an infant is on a ventilator.

The positioning swaddle 100 of the embodiments depicted in FIGS. 1-14 may include a pillow pocket 190 as depicted in FIG. 32. By way of example, but not limitation, a pillow may be inserted into a pillow pocket 190 of a positioning swaddle 100 to support the head or neck of an infant in a position that prevents plagiocephaly, according to the following procedure.

The positioning swaddle 100 may be positioned according to any method described herein. A pillow may already be inserted into the pillow pocket 190 between the first surface 196 and the second surface 198, or a pillow may be slid behind the head of an infant after the positioning swaddle 100 with the pillow pocket 190 has been positioned. The pillow may be secured inside the pocket 190 by engaging a fastener 202, such as by pressing together opposing pieces of VELCRO®. The pillow in the pillow pocket 190 helps support an infant's head or neck and helps prevent plagiocephaly. The pillow pocket 190 helps prevent the pillow from shifting out of position.

The positioning swaddle 100 of the embodiments depicted in FIGS. 1-4, 7 and 15-27 may include a leg support roll (not shown). By way of example, but not limitation, a positioning swaddle 100 may be used with a leg support roll to swaddle an infant, as well as to support the legs or hips of an infant, according to the following procedure.

The positioning swaddle 100 may be positioned according to any method described herein. The leg support roll may already be attached to the swaddle blanket 110, or it may be slid behind the legs of an infant after the positioning swaddle 100 has been positioned. The backs of the knees of the infant rest on the leg support roll. The leg support roll helps support the legs or hips of the infant and aids in optimal body positioning for proper hip alignment and CNS development.

Methods of Use of the Positioning Swaddle: Kangaroo Care

By way of example, but not limitation, the positioning swaddle 100 of FIGS. 1-4, 7, 15-17, and 30 may be used to perform kangaroo care with an infant according to the following procedure. The positioning swaddle 100 is placed on a surface such that at least the back surface 116 of the center section 112 is relatively flat against the surface on which it has been placed. None of the positioning rolls 102 or wings 120 are positioned between the back surface 116 of the center 156 of the center section 112 and the surface on which the center section 112 is resting. If an apron 160 is provided, it is not positioned under or on top of the center section 112. Some or all of the flaps 140 and wings 120 may be fully laterally extended as shown in FIG. 16.

An infant is placed in the supine position on the front surface 114 of the center section 112. The infant is placed approximately in the horizontal center 156 of the center section 112, as shown in FIG. 16, with its arms alongside its torso. The neck of the infant is positioned near top edge 136 of the center section 112. The legs of the infant may extend past the bottom edge 138 of the center section 112.

In another embodiment, the positioning swaddle 100 can be slid down the back of the head and body of an infant that is already in the supine position, which minimizes disturbance to and stress on the infant. The infant is positioned on the center section 112 as described in the preceding procedure.

When an apron 160 is provided, the feet and legs of the infant may rest on the first surface 166 of the apron 160 (see FIG. 8).

As shown in FIG. 16, a positioning roll 102 is drawn towards the infant, thereby drawing the adjacent wing 120 along the center section 112 of the swaddle blanket 110. The wing 120 is pulled taught such that the first surface 130 of the wing 120 lies substantially flat against the front surface 114 of the center section 112. The positioning roll 102 is rolled away from the infant, which rolls the distal end 124 of the wing 120 around the positioning roll 102, until the partially rolled positioning roll 102 is positioned on the swaddle blanket 110 adjacent to the infant.

Simultaneously or sequentially, the second positioning roll 102 is also positioned adjacent to the infant, as shown in FIG. 17, according to the preceding procedure. The positioning rolls 102 may be adjacent to the infant's arms that have been positioned alongside its torso. The positioning rolls 102 provide lateral support and a sense of security to the infant.

Each positioning roll 102 may be rolled away from the center 156 of the center section 112 more or less to accommodate different sizes of infants. For larger or wider infants, one or both of the positioning rolls 102 are rolled away from the center 156 of the center section 112 more than for smaller or narrower infants. Each positioning roll 102 can be unrolled or rolled at any time to provide a tighter or looser fit, respectively. The positioning swaddle 100 is therefore fully adjustable, can accommodate any size of infant, and can accommodate any given infant as the infant grows over time.

Figure 30:
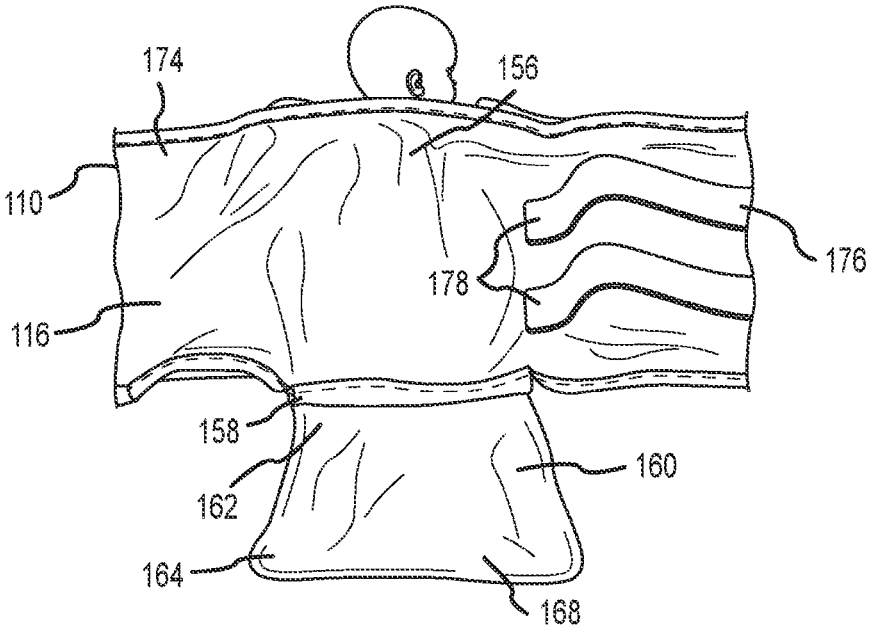
FIG. 30 is a rear plan view of the infant positioning swaddle of FIG. 1 in use for performing kangaroo care with an infant.

The infant is then positioned for kangaroo care on the chest of an adult, such as a parent. As much skin as possible on the infant's face, torso, and legs is brought into direct skin-to-skin contact with the bare chest of the adult. The rolled positioning rolls 102 remain positioned alongside the infant. The back of the infant is covered by, and can be kept warm by, the center section 112 of the swaddle blanket 110, as shown in FIG. 30. The flaps 140 and wings 120 can be spread laterally across the chest of the adult, and the apron 160, if present, can hang down toward the abdomen of the adult.

Performing kangaroo care with an infant using the positioning swaddle 100 promotes temperature regulation, heart and respiratory rate normalization, ready access to breastfeeding, and parent-child bonding. Also, when an infant has been positioned in the supine position according to the procedures described herein, or has been swaddled according to the procedures described herein, performing kangaroo care with the infant in the same positioning swaddle 100 minimizes stress on and disturbance to the infant because the infant does not have to be moved from one device to another. Instead, the same positioning swaddle 100 is used for all of supine positioning, swaddling, and kangaroo care.

Methods of Use of the Positioning Swaddle: Combination Methods

Components of each of the preceding methods of supine positioning, swaddling, and performing kangaroo care are not mutually exclusive to each method and may instead be performed in combination with each other. For example, the positioning swaddle 100 of FIGS. 1-33 may be used to simultaneously support an infant in a supine position and swaddle an infant according to the following procedure.

The positioning swaddle 100 is placed on a surface and an infant is placed on the positioning swaddle 100 according to any of the procedures described herein. One positioning roll 102 is rolled with the adjacent wing 120 and flap 140 to form a positioning wrap 154 as described herein. The positioning wrap 154 is rolled towards the center 156 of the center section 112 of the swaddle blanket 112 until the positioning wrap 154 is adjacent to the infant, as shown in FIG. 28.

Figure 28:
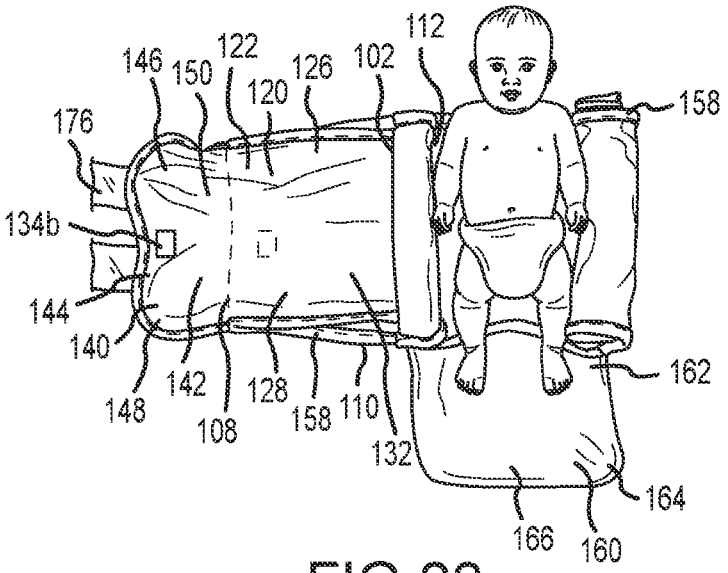
FIG. 28 is a front plan view of the infant positioning swaddle of FIG. 1 in use for swaddling an infant with one positioning member, wing, and flap in the rolled configuration.

As shown in FIG. 28, the opposing positioning roll 102 is drawn towards the infant and is positioned on the swaddle blanket 110 adjacent to the infant according to the swaddling procedures described herein.

Figure 29:
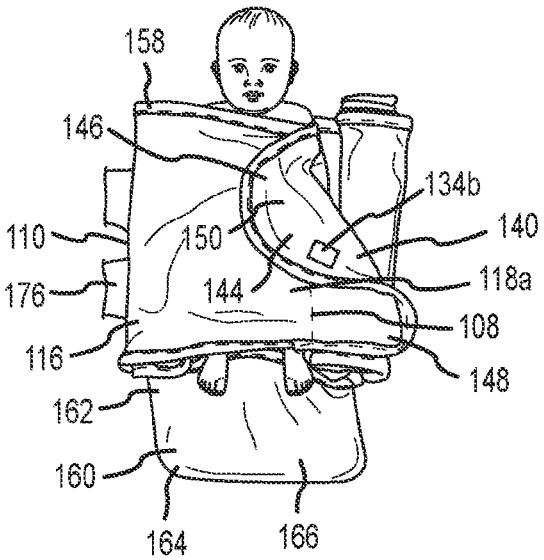
FIG. 29 is a front plan view of the infant positioning swaddle of FIG. 28 with the second flap and wing being folded across the infant.

As shown in FIG. 29, the flap 140 on the side of the positioning swaddle 100 opposing the positioning wrap 154 is drawn taught across the torso of the infant by pulling on the distal end 144 of the flap 140, which also draws on the attached wing 120 and center section 112. The distal end 144 of the flap 140 is then tucked around and under the positioning wrap 154 on the opposing side of the positioning swaddle 100. The second surface 152 of the flap 140 and the back surface 116 of center section 112 face outward, while the second surface 132 of the wing 120 faces the torso of the infant.

One or both securing straps 176 are then drawn across the swaddled torso of the infant, and the free ends 180 are tucked under the opposing positioning wrap 154 or under the swaddled back of the infant. The securing straps 176 may be positioned according to the procedures described herein.

Using the positioning swaddle 100 to simultaneously supine position an infant with a positioning wrap 154 and swaddle the infant helps maintain the infant in the supine position while also soothing the infant and helping the infant to fall asleep and remain asleep. The same positioning swaddle 100 is used for supine positioning, swaddling, kangaroo care, and combinations thereof, which minimizes stress on and disturbance to the infant because the infant does not have to be moved from one device to another.

Combination methods of use of the positioning swaddle 100 may also include a neck support roll 182, leg support roll, pillow, and/or heating or cooling pad as described herein.

Figure 15:
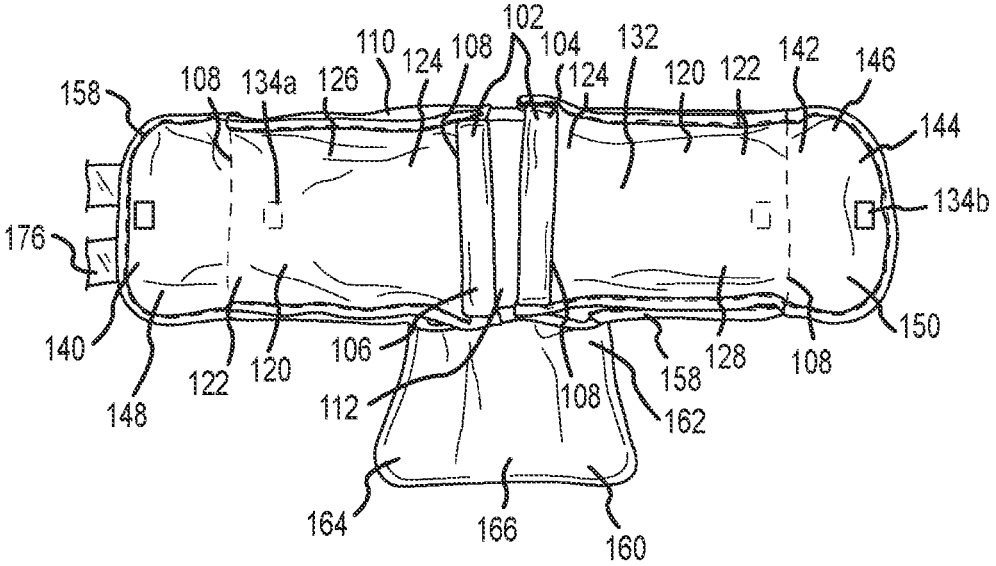
FIG. 15 is a front plan view of the infant positioning swaddle of FIG. 1 with the flaps extended, the wings collapsed, and the positioning rolls unrolled.
Figure 16:
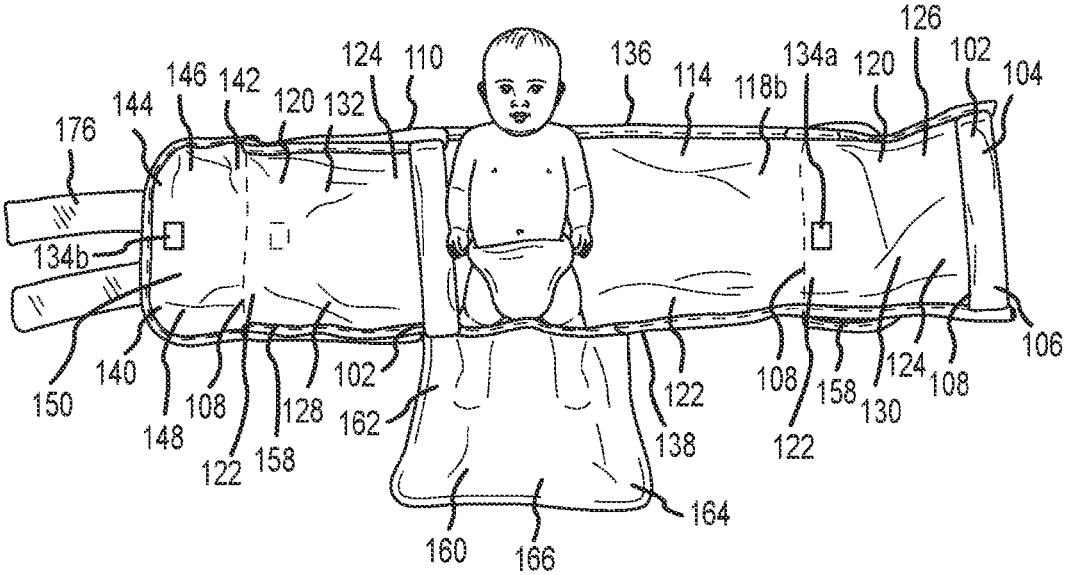
FIG. 16 is a front plan view of the infant positioning swaddle of FIG. 1 in use for swaddling an infant with one positioning roll in the partially rolled configuration.

The configuration of the positioning swaddle 100 can quickly and easily be transitioned between positioning, swaddling, and kangaroo care without returning to the starting points depicted in FIG. 3, 15, or 16. Use of the positioning swaddle 100 can quickly and easily transition between methods of positioning, swaddling, and kangaroo care without disturbing the infant or any medical devices. Use of a single positioning swaddle 100 for any of the methods described herein can continue as the infant grows because the positioning swaddle 100 is fully adjustable.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described herein with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A positioning swaddle comprising a center section comprising a first lateral end and a second lateral end;

a pouch secured to a bottom edge of the center section and configured to receive feet or legs of an infant;

a first flap and a first wing extending from the first lateral end; and a first cylindrically shaped, compression-resistant positioning roll attached to the first wing, wherein the first wing is configured to wrap around the first positioning roll in a rolled configuration, and wherein the first flap comprises a first fastener, and the first fastener is configured to secure the first positioning roll and the first wing in the rolled configuration.

2. The positioning swaddle of claim 1, wherein the first positioning roll is configured to support a torso of the infant in a supine or side-lying position when the first positioning roll is in the rolled configuration.

3. The positioning swaddle of claim 1, wherein the first positioning roll is configured to provide access to a torso of the infant for placement, removal, or monitoring of a medical device attached to the torso of the infant when the first positioning roll is in the rolled configuration.

4. The positioning swaddle of claim 1, further comprising at least one securing strap capable of securing the positioning swaddle to the infant.

5. The positioning swaddle of claim 1, wherein the pouch is defined by an apron secured to the bottom edge of the center section.

6. The positioning swaddle of claim 5, wherein the apron is foldable to define a receiving space configured to receive the feet or legs of the infant.

7. The positioning swaddle of claim 1, further comprising a pocket secured to a back surface of the swaddling blanket.

8. The positioning swaddle of claim 1, further comprising a pocket secured to a top edge of the swaddling blanket.

9. The positioning swaddle of claim 1, further comprising:

a second flap and a second wing extending from the second lateral end; and a second cylindrically shaped, compression-resistant positioning roll attached to the second wing, wherein the second wing is configured to wrap around the second positioning roll in a second rolled configuration, and wherein the second flap comprises a second fastener, and the second fastener is configured to secure the second positioning roll and the second wing in the second rolled configuration.

10. The positioning swaddle of claim 9, wherein the first positioning roll in the rolled configuration and the second positioning roll in the second rolled configuration define an adjustable gap between the first and second positioning rolls for sizing to accommodate a torso of the infant.

11. The positioning swaddle of claim 9, further comprising a support roll configured for releasable attachment to the center section near a midpoint between the first and second positioning rolls, wherein the support roll is configured to support a neck of the infant.

12. The positioning swaddle of claim 11, wherein the support roll comprises a depression and is configured such that the neck of the infant is configured to rest on the depression.

13. The positioning swaddle of claim 1, wherein the first flap is secured to both the center section and the first wing at a juncture.

14. A kit comprising the positioning swaddle of claim 1, the kit further comprising:

at least one support roll; and a launderable bag.

15. The kit of claim 14, wherein the at least one support roll supports is configured to support a neck of the infant.

16. A positioning swaddle comprising a swaddle blanket comprising:

a center section comprising a first lateral end and a second lateral end, a pouch secured to the center section and configured to receive feet or legs of an infant, a first flap and a second flap, the first flap and the second flap each comprising a proximal end and a distal end, and a first wing and a second wing, the first wing and the second wing each comprising a proximal end and a distal end, wherein the first lateral end is secured to the proximal end of the first flap at a first juncture, and to the proximal end of the first wing at the first juncture;

wherein the second lateral end is secured to the proximal end of the second flap at a second juncture, and to the proximal end of the second wing at the second juncture;

wherein a first cylindrically shaped positioning roll is secured to the distal end of the first wing, and a second cylindrically shaped positioning roll is secured to the distal end of the second wing, wherein the first wing is configured to wrap around the first positioning roll in a first rolled configuration, and the second wing is configured to wrap around the second positioning roll in a second rolled configuration, and wherein the first flap comprises a first fastener configured to secure the first positioning roll and the first wing in the first rolled configuration, and the second flap comprises a second fastener configured to secure the second positioning roll and the second wing in the second rolled configuration.

17. The positioning swaddle of claim 16, wherein the first and second positioning rolls define an adjustable gap between the first and second positioning rolls for sizing to accommodate a torso of the infant.

18. The positioning swaddle of claim 16, wherein the distal end of the first flap wraps around the second positioning roll on the distal end of the second wing when the swaddle blanket is wrapped around the infant.

19. The positioning swaddle of claim 16, further comprising at least one securing strap capable of securing the positioning swaddle to the infant.

20. The positioning swaddle of claim 16, wherein the pouch is defined by a foldable and rollable apron secured to a bottom edge of the center section.

21. A method of using the positioning swaddle of claim 16, the method comprising:

placing the infant in a supine or side-lying position on the swaddle blanket;

wrapping the first wing around the first positioning roll from the distal end to the proximal end of the first wing;

wrapping the second wing around the second positioning roll from the distal end to the proximal end of the second wing;

securing the first flap to the first wing wrapped around the first positioning roll to form a first positioning wrap;

securing the second flap to the second wing wrapped around the second positioning roll to form a second positioning wrap; and rolling the first positioning wrap and the second positioning wrap towards the infant until the first positioning wrap and the second positioning wrap are positioned adjacent to the infant.

22. The method of claim 21, further comprising securing the positioning swaddle to the infant by wrapping at least one securing strap around both the first and second positioning rolls and the infant.

23. The method of claim 21, further comprising inserting the feet of the infant into the pouch, wherein the pouch is secured to a bottom edge of the center section of the swaddling blanket.

24. The method of claim 21, wherein the pouch is defined by a rollable apron.

25. A positioning swaddle comprising:

a rectangular fabric swaddling blanket comprising:

a center section comprising a first lateral end and a second lateral end, a pouch secured to a bottom edge of the center section and configured to receive feet or legs of an infant, a first flap and a second flap, a first wing and a second wing, and at least one securing strap, wherein the first lateral end of the center section is secured at a juncture to the adjacent first flap and the adjacent first wing at a first juncture, and wherein the second lateral end of the center section is secured to the second flap and the second wing at a second juncture;

a first cylindrically shaped, compression-resistant positioning roll attached to an end of the first wing distal from the first juncture; and a second cylindrically shaped, compression-resistant positioning roll attached to an end of the second wing distal from the second juncture, wherein the first wing is configured to wrap around the first positioning roll in a first rolled configuration, and the second wing is configured to wrap around the second positioning roll in a second rolled configuration, and wherein the first flap comprises a first fastener configured to secure the first positioning roll and the first wing in the first rolled configuration, and the second flap comprises a second fastener configured to secure the second positioning roll and the second wing in the second rolled configuration.

26. A method of using the positioning swaddle of claim 25, the method comprising:

placing the infant in a supine position on the swaddle blanket;

drawing the first positioning roll, the second positioning roll, the first wing, and the second wing towards the infant until the first positioning roll and the second positioning roll is adjacent to the infant;

drawing the first flap across the infant and securing the first flap under the second positioning roll;

drawing the second flap across the infant and securing the second flap under the first positioning roll; and securing the positioning swaddle to the infant by wrapping the at least one securing strap around the infant.

27. The method of claim 26, further comprising rolling the first positioning roll and the second positioning roll towards or away from the infant to adjust a distance between the first and second positioning rolls.

* * * * *